US006588125B2

(12) United States Patent
Proctor, Sr.

(10) Patent No.: US 6,588,125 B2
(45) Date of Patent: Jul. 8, 2003

(54) ARTICULATED SKI BOOT

(76) Inventor: Charles Wesley Proctor, Sr., 1108 E. Dover Rd., Greensboro, NC (US) 27408

( * ) Notice: Subject to any disclaimer, the term of this patent is extended or adjusted under 35 U.S.C. 154(b) by 0 days.

(21) Appl. No.: 09/862,625

(22) Filed: May 22, 2001

(65) Prior Publication Data

US 2002/0174570 A1 Nov. 28, 2002

(51) Int. Cl.[7] ..... A43B 5/04

(52) U.S. Cl. ..... 36/117.1; 36/117.4; 36/117.5; 36/117.9

(58) Field of Search ..... 36/117.1, 117.3, 36/117.4, 117.6, 117.5, 117.7, 117.9, 118.7, 103, 29

(56) References Cited

U.S. PATENT DOCUMENTS 2,649,306 A 8/1953 Hilding
4,627,636 A 12/1986 Payraud
4,677,769 A 7/1987 Ahmad et al.
4,718,694 A 1/1988 Brice et al.
4,839,972 A 6/1989 Pack et al.
4,880,251 A 11/1989 Wulf et al.
4,920,665 A 5/1990 Pack et al.
5,020,822 A 6/1991 Wulf et al.
5,026,087 A 6/1991 Wulf et al.
5,572,806 A 11/1996 Osawa
5,829,776 A 11/1998 Deville et al.

*Primary Examiner*—Anthony D. Stashick
(74) *Attorney, Agent, or Firm*—Darby & Darby

(57) ABSTRACT

An articulated ski boot for releasable attachment to a binding mounted on an alpine ski is presented. The ski boot has a sole which preferably is formed of first and second rigid portions with a hinge connecting the two portions such that the first portion is upwardly pivotable when the sole is free from the binding (walking mode). The boot has a substantially rigid boot upper adapted to receive a foot and which is attached to the sole. A truss member is pivotally connected to the boot upper and pivots between the walking mode and a locked skiing mode in which the sole portions are prevented from pivoting. The ski boot also includes means for securing the skier's forefoot and heel to the sole to substantially reduce toe and heel lift.

16 Claims, 8 Drawing Sheets

ARTICULATED SKI BOOT

BACKGROUND OF THE INVENTION

1. Field of the Invention

The present invention relates to an alpine ski boot for releasable attachment to an alpine ski. In particular, it relates to an alpine ski boot articulated to facilitate comfort, safety and wearability of the boot both on the ski for skiing and off the ski for walking.

2. Description of Related Art

Presently, ski boots for alpine skiing are generally of a construction having a rigid plastic upper and a rigid boot sole. This construction is preferred for several reasons. For alpine ski boots, it is believed that a rigid boot sole is advantageous when used with contemporary quick-release bindings, particularly bindings of the type that engage an extension of the toe end of the rigid sole and an extension of the heel end of the rigid sole. Quick-release bindings generally have spring loaded mechanisms that allow a user to easily attach a ski by placing the extension of the toe end of a booted foot into a front part of the automatic binding and then stepping down on the boot heel to engage the extension of the heel end of the boot in a rear part of the binding to lock the boot to the ski in a clamping engagement. The boot is easily releasable from the binding by a trigger mechanism selectively activated by the user with a pole or an opposite foot. Generally, the quick-release bindings are also adapted to release the rigid boot sole automatically at a predetermined setting in extraordinary loading situations, such as during an unplanned or accidental fall, allowing the skier's booted foot to separate from the ski, thus reducing the risk of the ski causing injury to the skier.

The binding firmly clamps the rigid boot sole to the ski, so that, under ordinary skiing conditions, the ski boot, and thus the skier's foot inside the ski boot are held firmly with respect to the ski attached to the binding. The firm hold of the skier's foot with respect to the ski is essential to facilitate the skier's ability to control the orientation of the skis with respect to the surface being traversed, e.g., mountain slopes, and thereby, to safely control the direction and speed of travel on those surfaces. All alpine safety bindings conform to DIN standards which require exacting sole dimensions to activate properly. In addition, the newer shaped alpine skis have increasingly gained both popularity and a larger market share. These newer shaped skis are steered differently by the skier than prior alpine skis which had straight sides. More specifically, there is a greater emphasis on ankle angulation to turn the ski. This angulation of the ankle within a rigid boot structure conveys this body movement to the skis. To boost the affect of angulation, most skis and/or bindings are fitted with lifts to increase the leverage of angulation. This increases the need for a very rigid boot structure to avoid accidental binding release during sudden or high-speed maneuvers.

In alpine skiing, rigid uppers are preferred because they are known to prevent the foot and ankle injuries common to skiers using an earlier style of boot and binding, namely leather boots with flexible uppers received in fixed non-automatic bindings. In an accident, the earlier style of boot and binding afforded little or no support or protection to foot and ankle bones against twisting into unnatural positions due to the lever arm effect of a long ski unyieldingly attached to the foot. Thus, these bones were susceptible to injury or breakage. Rigid uppers substantially eliminate the likelihood of injury to the foot or ankle. These uppers generally extend well above the ankle and are adapted to be tightly fastened about the foot and ankle to restrict movement of the foot and flexibility of the ankle with respect to the ski and the lower leg.

By restricting movement of the foot and flexibility of the ankle with respect to the lower leg, rigid uppers combined with rigid soles are also known to provide a rigid link-up between a skier's foot and leg, which allows the skier to properly shift and direct body weight to the skis and to effect greater control of the orientation and direction of the skis. Turning, which determines both the speed and direction of travel, is easier with rigid uppers and rigid soles. Skis have substantially parallel sides that cause the skis to travel in a straight line, and resist turning. To overcome this bias towards straight line travel, skis generally require a weight shift towards the front of the ski (i.e., "forward loading") to bend a forward part of the ski sufficiently to induce the ski to carve a turn in the desired direction. It is believed that rigid uppers combined with rigid soles better accomplish this forward loading by restricting movement of the foot and ankle relative to the lower leg, and by holding the foot such that it is pitched or angled forward slightly causing the skier to assume a posture with knees slightly bent. Thus, boots with rigid soles and rigid uppers exhibit several advantages preferred by alpine skiers.

Boots with rigid uppers and rigid soles also have a significant disadvantage in that they are cumbersome and difficult to walk in when released from the skis. While skiing, a skier wearing a pair of boots each with a rigid sole and rigid upper has significantly enhanced control and maneuverability due to the rigid construction of the boots which firmly position the foot with respect to the ski. However, once released from the skis, the mobility and maneuverability of the wearer is severely handicapped by the rigid upper and the rigid sole. Maneuvering about a ski area with the skis removed from the boots, such as, for example, maneuvering in the ski lodge, or to and from a locker or a vehicle, requires extra effort and agility on the part of the wearer. Because the toes are not free to flex with respect to the rest of the foot, and because the foot is not free to flex with respect to the leg, the rigid upper and the rigid sole make walking on level, dry surfaces difficult, while traversing slopes and staircases is particularly hazardous. The slippery conditions caused by ice, melting snow and mud commonly found both outside and inside ski facilities compound the maneuverability problems associated with walking in ski boots having rigid uppers and rigid soles, and may result in falls and injuries. It is not uncommon to see skiers of various ages and skill levels flailing their arms in an attempt to regain their balance off the skis because ski boots with rigid uppers and rigid soles do not permit movement of the toes, foot and ankle in a natural manner.

U.S. Pat. Nos. 5,026,087, 5,020,822 and 4,880,251, all to Wulf et al., disclose a ski boot having a boot upper, i.e., a foot shell formed of two rigid segments attached to a sole. The segments of the foot shell overlap in sliding engagement so that a living hinge is created in the integral sole at approximately the location of the ball of the foot within the boot. To make the sole rigid for use on a ski, the fulcruming of the living hinge is eliminated by locking the overlapping segments of the foot shell together, thus forming what is essentially a rigid upper from the two segments. The sole therefore derives its rigidity from the foot shell. In addition, the boot disclosed by Wulf et al., is attached to a ski by way of a binding connected to a rear portion of the sole only, i.e., the boot is not attached by a toe end of the sole, thus shortening the length of the portion of the sole attached in the binding and correspondingly reducing the lever arm advantage of the sole in turning the ski.

U.S. Pat. No. 5,572,806 to Osawa discloses a flexible ski boot with an upper having a flexible portion behind the toe and a sole having a rigid toe portion connected by a hinge to a rigid heel portion. When the boot is received in a binding, a mechanism incorporated in the sole is activated to extend a bar-like member from a clearance in the toe portion into a hole in the heel portion to lock the toe portion of the sole in alignment with the heel portion of the sole. However, the disclosure indicates that even when the boot is attached to a ski, the boot upper has a degree of flexibility when the ski is subjected to stresses. Since the boot upper is connected to the ski by way of the sole, this would imply that the sole also has a degree of flexibility when attached to the ski. In the disclosure, this is viewed as an advantage because the boot upper is less susceptible to cracking when the ski is on uneven surfaces. However, while a boot with an upper or sole having a small degree of flexibility may be suitable for typical recreational use, it would almost certainly be unsuitable for competitive or extreme recreational use where precise control of the ski is essential. The disclosure also does not address an arrangement typical of contemporary boot and binding combinations, i.e., bindings having a toe pad and heel pad that elevate the bottom surface of the boot sole from the top surface of the ski such that the middle portion of the sole is unsupported. For a one piece rigid sole, an unsupported middle portion is not a problem. However, with a hinged two-part sole, the unsupported middle portion of the sole tends to flex toward the top surface of the ski, which could in turn cause premature or undesired release of the boot from the binding.

Another disadvantage of conventional alpine ski boots is that the boots unsatisfactorily bind the forefront, ankle, and shin securely to the rigid shell. As previously mentioned, such binding is desirable because it immediately conveys skier movements from the boots to the skis. Typically, alpine ski boots contain a soft bladder or inner boot which encases the skier's foot. In an effort to more solidly bind the foot, ski boot manufacturers have attempted to secure the foot inside the bladder to the rigid shell by compressing the overlapping shell against the bladder by means of ratcheting buckles. Because people have a wide variety of foot shapes (e.g., thin, wide, high insteps, flat, etc.), it is difficult to ratchet the rigid plastic shell against the inner bladder and such action often causes discomfort to the skier. For example, over-ratcheting of the shell often results in a cut off in circulation to the foot, thereby causing the skier to get cold feet. Furthermore, heel lift from inside the rigid boot floor is detrimental to properly guiding the skis and is common in all ski boots having rigid shells. Ski boot manufacturers have dealt poorly with the problem of heel lift inside the boot by designing the inner bladder to tightly compress against the ankle, thereby causing discomfort and other problems. To prevent heel lift, some skiers resort to buckling their boots so tightly as to cut off circulation.

Most conventional alpine ski boots are front entry boots having an overlapping plastic flange on the forefoot thereof. This overlapping flange is pulled together by external ratchet straps. This overlap makes boot entry difficult as the foot must spread one flange section away from another flange section. Because of their rigidity, the flange sections try to retain their original shapes and this makes it difficult for the skier to place his/her foot in the boot.

Accordingly, it was previously thought that, in order to properly interact with an alpine ski binding that engages the toe end and the heel end of a sole, for entry and release manually or automatically, a boot sole must be completely rigid from heel to toe; and in order to provide the stiff up-link between a skier's foot and leg preferred for proper control of a ski while skiing, a boot upper and boot sole combination must be substantially rigid from heel to toe and from sole to ankle cuff. However, this construction suffers from the aforementioned disadvantages as well as others.

Thus, there is a need for an alpine ski boot that will properly interact with a ski binding that engages a toe end and a heel end of a sole, that provides a rigid up-link from the skier's foot to the skier's leg, while facilitating comfort, mobility and maneuverability not only on the ski but off the ski as well, as well as overcoming the other above-mentioned disadvantages associated with conventional alpine skis.

SUMMARY OF THE INVENTION

According to the present invention, a ski boot is presented and includes a segmented boot upper attached to a two part rigid foot bed member. The foot bed member has a rigid first portion corresponding to a toe part of the foot, and a rigid second portion corresponding to the arch and heel parts of the foot. The first portion is hinged to the second portion at approximately the location of the ball of the foot within the boot. The boot upper has a rigid toe portion connected to the first portion of the foot bed member and a rigid heel portion connected to the second portion of the foot bed member. A wedge-shaped gap is provided between the toe portion and the heel portion of the upper to permit the first portion of the foot bed member to pivot with respect to the second portion. The boot is provided with a stop means such that one portion of the hinged sole may pivot above a plane passing through the other portion, but may not pivot below that plane.

When the hinged sole is received in an alpine ski binding which engages portions of the toe and heel of the boot, the first and second portions of the foot bed member are aligned in a single plane. In this position, the foot bed member act as a unitary, rigid member. The ski boot further includes a selectively locking articulated truss assembly which extends across the wedge-shaped gap and serves to lock the toe portion of the boot upper to the heel portion thereof. One end of the truss assembly is attached to the toe portion, while the other end is the end which selectively locks with a truss locking section of the heel portion. The truss assembly includes a knob which permits the user to lock or unlock the truss assembly. When the user desires for the toe portion to be able to pivot relative to the heel portion, as in the case of walking, the user simply unlocks the truss assembly from the heel portion, thereby permitting the toe and heel portions to pivot about the hinged foot bed member. In skiing mode, the truss assembly is in a locked position.

The ski boot also includes internal/external adjustable straps which are disposed at least partially between an inner boot bladder and the hard shell of the ski boot. These straps overcome the difficulties in properly fitting the rigid shell to the skier's foot. The two straps are anchored inside of the rigid boot cavity to the floor of the foot bed member. One strap passes over the top of the inner bladder at the forefoot location and the other strap passes over the top of the bladder at the ankle bend of the foot. Each strap is coupled to a respective thumbscrew device which is coupled to the boot upper. The thumbscrew devices are designed so that the user may rotate handles thereof to cause the straps to be tightened. To loosen the straps, the user moves a lever of the thumbscrew device which causes the strap to be freely loosened. Pressing the hard shell against the inner bladder is eliminated at the forefront and ankle and positive hold down of the forefoot and heel is achieved. This improves comfort and performance is enhanced by providing instant feedback of steering motions to the hard shell of the boot and hence to the skis.

Other features and advantages of the present invention will be apparent from the following detailed description when read in conjunction with the accompanying drawings.

DETAILED DESCRIPTION OF THE DRAWINGS

The foregoing and other features of the present invention will be more readily apparent from the following detailed description and drawings of illustrative embodiments of the invention in which:

FIG. 2 is an exploded side view showing the articulated ski boot of FIG. 1 along with an exemplary alpine ski having an alpine ski binding to which the articulated ski boot of the present invention may be secured to;

DETAILED DESCRIPTION OF THE INVENTION

Figure 1:
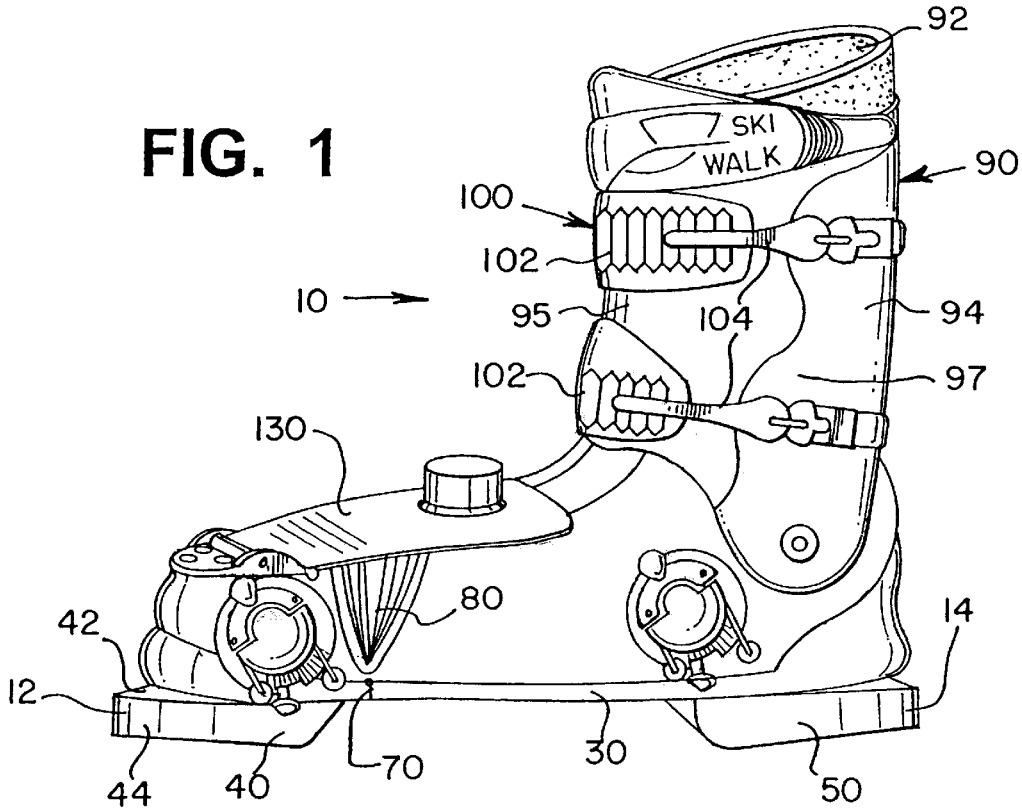
FIG. 1 is a side perspective view of an articulated alpine ski boot according to one embodiment of the present invention.
Figure 2:
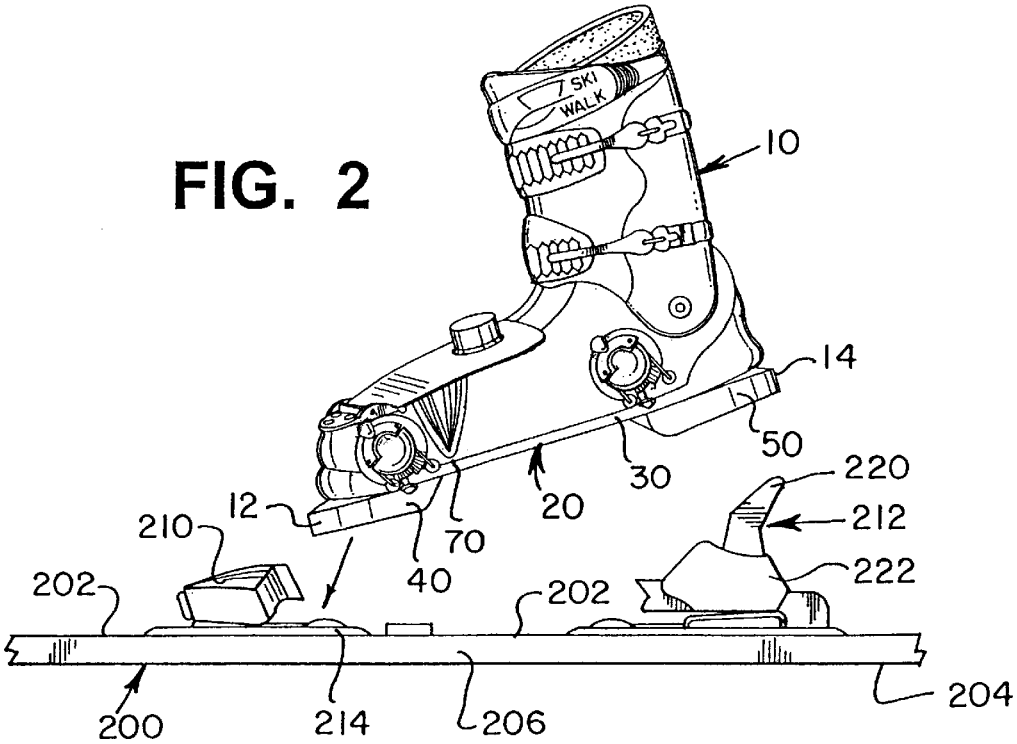
Figure 3:
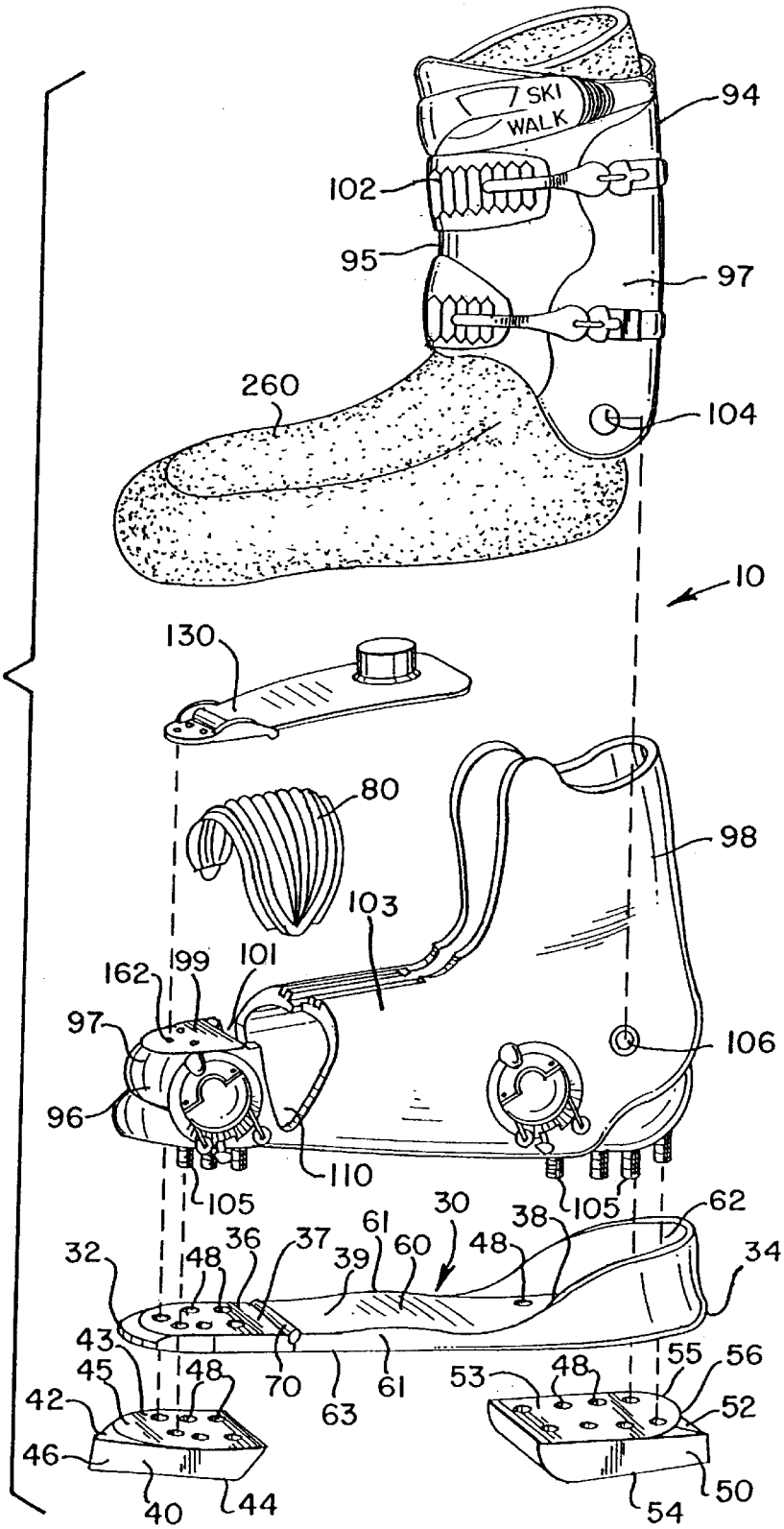
FIG. 3 is an exploded perspective view of the articulated alpine ski boot of FIG. 1 showing the modular components thereof.

Referring to FIGS. 1–3, an articulated alpine ski boot according to one embodiment of the present invention is shown generally at 10 in FIG. 1. The ski boot 10 has a front (toe) end 12 and an opposing rear (heel) end 14. In FIG. 2, the ski boot 10 is shown in a disengaged state relative to a typical alpine ski 200 (partially shown) to which the ski boot 10 is attached for skiing. The ski 200 has a top surface 202, a bottom surface 204 and opposite sides 206. The ski boot 10 is attached to the ski 200 by way of a conventional representative alpine ski binding mounted on the top surface 202 of the ski 200. The ski boot 10 is designed to fit any type of alpine ski 200 including the newer types of alpine skis 200 which have progressive side cuts. In fact, the ski boot 10 is particularly well suited for use with these newer types of alpine skis 200 which require different user movements to successfully steer and turn the skis 200.

The conventional representative binding has a toe binding 210 adapted to receive a part of the front toe end 12 of the boot 10 and a heel binding 212 which is adapted to receive a part of the rear heel end 14 of the boot 10. The conventional binding also typically has a toe pad or riser 214 supporting the toe end 12 of the boot 10 and a heel pad or riser 216 supporting the heel end 14 of the boot 10 such that a portion of a boot sole 20 between the toe end 12 and the heel end 14 is spaced above the top surface 202 of the ski 200, thus forming an air gap between a bottom surface of the sole 20 and the top surface 202 of the ski 200 when the ski boot 10 is secured to the boot binding.

For purposes of illustration only, the conventional binding is shown as a two part binding with separate front and rear parts; however, it will be understood that other types of bindings are also suitable for use with the boot 10 of the present invention, so long as the binding receives and engages a part of the toe end 12 of the boot 10 and a part of the heel end 14 of the boot 10 as described in greater detail below. One exemplary binding has a binding release lever 220 and a release member 222. Generally, the release member 222 pivots upwardly or laterally outwardly to effect release of the boot 10 from the binding in response to the user selectively actuating the release lever 220. Alternatively, the release member 222 effects release of the boot 10 automatically in response to an extreme loading situation, such as, for example, when a skier unintentionally falls or encounters a non-traversable object or surface.

As used herein, forward or front indicates a position or orientation closer to the toe of the boot 10 and forwardly indicates a direction towards the toe of the boot 10. Conversely, rear or behind indicates a position or orientation closer to the heel of the boot 10 and rearwardly indicates a direction towards the heel of the boot 10. Top, up, upwardly, bottom, down, downwardly and all other terms not specifically defined will each take on the definition ascribed in their respective conventional usage unless otherwise indicated herein.

The ski boot 10 includes a foot bed member 30, a toe lug 40 and a heel lug 50. The toe lug 40 and heel lug 50 serve as the members which engage and are locked in place by the toe binding 210 and heel binding 212, respectively, of the ski 200. The toe lug 40 has an upper surface 42 and an opposing lower surface 44 with the upper surface 42 being configured to receive a toe end 32 of the foot bed member 30. For example, the upper surface 42 may include a recessed platform, generally indicated at 43, defined at least in part by a shoulder 45 which serves as a locator and stop when the toe end 32 of the foot bed member 30 is disposed in the recessed platform. In the exemplary embodiment, the toe end 32 has an arcuate shape and therefore the shoulder 45 has a complementary arcuate shape. The toe lug 40 has a toe binding portion 46 which engages the toe binding 210 during the binding operation such that the toe binding portion 46 is securely locked in place by the toe binding 210. The toe binding portion 46 is defined as the forward area of the toe lug 40. The toe lug 40 also has a predetermined number of openings 48 formed therein. The openings 48 receive suitable fasteners or the like (not shown) which also extend through the foot bed member 30 and a shell body of the ski boot 10 so as to securely fasten the components together. The openings 48 are therefore formed in the recessed platform 43. While the toe lug 40 may be formed from any number of materials, it is preferably formed of a rigid plastic material.

The heel lug 50 is similar in design to the toe lug 40 and includes an upper surface 52 and an opposing lower surface 54 with the upper surface 52 being configured to receive a heel end 34 of the foot bed member 30. For example, the upper surface 52 may include a recessed platform, generally indicated at 53, defined at least in part by a shoulder 55 which serves as a locator and stop when the heel end 34 of the foot bed member 30 is disposed in the recessed platform 53. In the exemplary embodiment, the heel end 34 has an arcuate shape and therefore the shoulder 55 has a complementary arcuate shape. The heel lug 50 has a heel binding portion 56 which engages the heel binding 212 during the binding operation such that the heel binding portion 56 is securely locked in place by the heel binding 212. The heel lug 50 also has a number of openings 48 formed therein and more particularly, the openings 48 are preferably formed in the recessed platform 53. As with the openings 48 formed in the toe lug 40, these openings 48 permit fasteners (not shown) to be used to securely fasten the heel lug 50, the foot bed member 30 and the body shell of the ski boot 10 together.

The height of each of the toe and heel lugs 40, 50 can be varied so that the foot bed member 30 can be located a certain predetermined distance above the upper surface 202 of the ski 200. Because the toe and heel lugs 40, 50 are detachably coupled to the other parts of the ski boot 10, the toe and heel lugs 40, 50 may easily be interchanged with others that have different heights. This permits the skier to tailor the ski boot 10 depending upon a number of parameters, including the skill level of the skier and the particular course conditions.

Referring to FIGS. 1–8, the foot bed member 30 has a rigid first portion 36 extending from the toe end 32 rearwardly to a rear pivot end 37 and a rigid second portion 38 extending forwardly from the heel end 34 to a front pivot end 39 of the second portion 38. The front pivot end 39 is positioned adjacent to and aligned with the rear pivot end 37 of the first portion 36. The foot bed member 30 may be formed of any number of rigid materials and in one embodiment, the foot bed member 30 is formed of a metal. For example, the foot bed member 30 may be formed of titanium which offers the desired structural support while being lighter in weight than other types of metals.

The foot bed member 30 has an upper surface 60 and an opposing lower surface 63 which partially seats against the toe and heel lugs 40, 50. As shown in FIG. 2, the foot bed member 30 is a flanged member having lateral flanges 61 and a heel flange 62. The lateral flanges 61 are formed on side portions of both the first portion 36 and the second portion 38 while the heel flange 62 is formed at the heel end of the second portion 38. The lateral flanges 61 and heel flange 62 extend upwardly from the respective portions of the upper surface 60 of the foot bed member 30. It will be appreciated that the lateral flanges 61 serve to limit the lateral movement of the ski boot 10 and the heel flange 62 serves to limit toe to heel movement. Preferably the lateral flanges 61 and heel flange 62 are integrally formed with respect to one another so that the flange is a continuous member which extends upwardly from the upper surface 60.

The foot bed member 30 also has a number of openings 48 formed therein which receive the fasteners which are disposed through the corresponding openings 48 formed in each of the toe lug 40 and the heel lug 50. In other words, there are complementary openings 48 formed in the first portion 36 and the second portion 38 which align with the openings 48 formed in the toe lug 40 and the heel lug 50 so as to permit the fasteners to extend through both the toe lug 40, heel lug 50 and the foot bed member 30. This permits the toe lug 40 and the heel lug 50 to be securely attached to the bottom surface of the foot bed member 30.

A flexible connector, preferably in the form of a hinge 70 (see FIGS. 19 and 20), is preferably concealed under a waterproof membrane 80 and connects the rear pivot end 37 of the first portion 36 to the front pivot end 35 of the second portion 38 approximately at a point along the foot bed member 30 corresponding to a point at which the toes of a foot received in the ski boot 10 would flex upwardly relative to the rest of the foot, i.e., approximately where the ball of the foot would be positioned in the ski boot 10. The first portion 36 is connected to the second portion 38 by the hinge 70 such that when the ski boot 10 is captured in a ski binding of the general type described above, i.e., with a part of the toe lug 40 received in the toe binding 210 and a part of the heel lug 50 received in the heel binding 212, the first portion 36 is firmly held in planar alignment with the second portion 38 to form a continuous rigid foot bed member 30. The first portion 36 is also connected to the second portion 38 by the hinge 70 such that, when the ski boot 10 is released from the binding of the ski 200, the first portion 36 can pivot relative to the second portion 38 to displace the toe end 32 of the member 30 above a plane containing the second portion 38.

Although in one exemplary embodiment, the ski boot 10 is received in a representative binding by way of binding portions 46, 56 formed as part of the lugs 40, 50, respectively, it will be appreciated that other structural arrangements are contemplated which do not depart from the spirit of the invention. In other words, other structural arrangements could be substituted for one or both binding portions 46, 56 to engage the ski boot 10 in the binding. For example, one or both binding portions 46, 56 could be replaced with a member extending in any suitable direction so long as it is of a size and strength such that the first sole portion 36 is firmly held in planar alignment with the second portion 38 when the ski boot 10 is engaged in the binding. Similarly, one or both binding portions 46, 56 can be replaced with bores, grooves or recesses designed to engage a ski boot in a binding.

Figure 19:
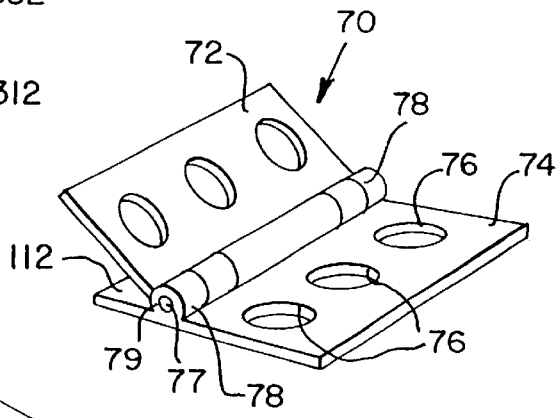
FIG. 19 is a perspective view of a hinge for use in the foot bed member shown in FIG. 13 with the hinge being in an open position.
Figure 20:
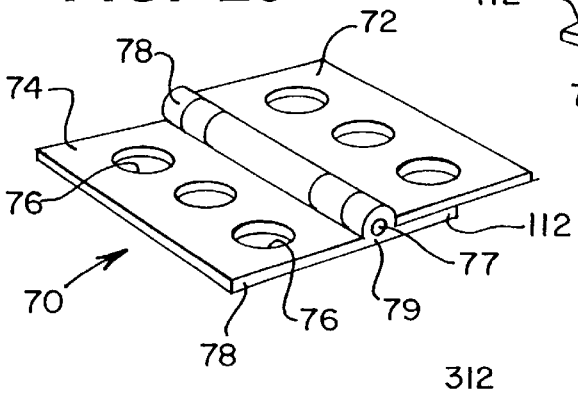
FIG. 20 is a perspective view of the hinge of FIG. 19 showing the hinge in a closed position.

As best shown in FIGS. 1 and 2, the hinge 70 is recessed into the foot bed member 30 to minimize the profile of the hinge 70 in the sole construction (i.e., the foot bed member 30), to protect the hinge 70 from wear and abrasion and to prevent the hinge 70 from interfering with the foot bed member 30 and the ski 200. The flexible attachment or hinge 70 between the first and second portions 36, 38 is preferably a conventional hinge such as, for example, a butt hinge, piano hinge or pin hinge. The hinge 70 that is shown in FIGS. 2, 19 and 20 is also commonly referred to as a one way hinge since the hinge 70 only opens in one direction and its range of movement is therefore limited, as will be described in greater detail hereinafter. It will be appreciated that other types of flexible connectors are contemplated, such as, for example, a flexible cord or cable, a flexible sheet material, a flexible web, a fabric, a membrane, etc. Thus, the flexible connector or hinge 70 can be any construction of suitable strength and dimension to permit the first portion 36 to pivot with respect to the second portion 38, and of suitable strength and dimension to permit the first portion 36 and the second portion 38 to be firmly held in planar alignment when the toe and heel lugs 40, 50 are captured in a ski binding as described above. It will also be appreciated that the flexible connector may alternatively be a one way hinge that is formed integrally with and from the materials of the first and second portions 36, 38 of the foot bed member 30.

As best shown in FIGS. 2, 19 and 20, the hinge 70 is preferably a butt hinge including a first hinge plate 72 for attachment to the first portion 36 and a second hinge plate 74 for attachment to the second portion 38. Apertures 76 are provided in each of the hinge plates 72, 74 to accommodate fasteners, such as screws or rivets, for attaching the hinge plates 72, 74 to the respective first and second portions 36, 38. Each of the hinge plates 72, 74 has lugs 78 oppositely arranged to cooperate in a closely spaced, interposed arrangement. A pin 77 passes through a bore 79 in the lugs 78. The illustrated hinge 70 may also be referred to as a 180° one-way hinge.

The ski boot 10 also generally includes a shell body which has a boot upper 90 best shown in FIGS. 1–3. The boot upper 90 has an upwardly directed leg opening 92, defined by an upper cuff 94, designed to accommodate entry of the foot into the ski boot 10. The boot upper 90 is dimensioned to define a foot chamber for receiving a user's foot. The boot upper 90 generally has two main components, namely a toe upper portion 96 corresponding to a portion of the ski boot 10 that receives the toes of the user's foot and a heel upper portion 98, defined herein as substantially all of the side, top and rear walls of the boot upper 90 behind the toe upper portion 96. Thus, as defined herein, the heel upper portion 98 comprises a substantial part of the sides and rear of the boot upper 90, extending from the heel end 14 of the ski boot 10 forward towards the toe upper portion 96, and extending upwardly from the foot bed member 30 substantially to the top of the ski boot 10 to form at least a rear part of the cuff 94 of the boot 10.

The heel upper portion 98 is configured to substantially enclose the heel, the ankle, and the mid part of the foot of a wearer when the foot is positioned in the boot. The toe upper portion 96 and the heel upper portion 98 are shaped and sized to receive a wearer's foot and are also substantially rigid to firmly seat the foot in the foot chamber such that transmission of leverage or loading forces from the wearer's foot and lower leg to the ski 200 attached to the boot 10 is facilitated.

The cuff 94 is preferably formed of a rigid plastic material and has a generally overlapping structure when the cuff 94 is tightened. The cuff 94 has a first section 95 and a second section 97 with at least a portion of the first and second sections 95, 97 overlapping one another when the cuff 94 is closed and clamped about the wearer's lower leg. Clamping of the first section 95 to the second section 97 is effected by any number of conventional clamping means, such as, for example, a ratchet strap system 100 having a strap 102 and a ratchet buckle. When clamped on the wearer's foot, the substantially rigid boot upper 90, along with the rigid toe upper portion 96 and the rigid heel upper portion 98, provides excellent lateral support and stability and facilitates control of the orientation of the ski 200 attached to the boot 10. The cuff 94 has a pair of spaced openings 104 formed therein at a lower portion thereof. Preferably the openings 104 are located generally about 180° apart from one another. The openings 104 receive pivot pins 106 which extend outwardly from the heel upper portion 98 to permit pivoting of the cuff 94 relative to the heel upper portion 98 during use of ski boot 10 to accommodate a range of motion of the wearer's lower leg.

The toe upper portion 96 is supported on and secured to the first portion 36, and is thus dimensioned accordingly. Similarly, the heel upper portion 98 of the boot upper 90 is supported on and secured to the second portion 38, and is dimensioned accordingly. Any number of techniques may be used to secure both the toe upper portion 96 to the first portion 36 and the heel upper portion 98 to the second portion 38. As previously mentioned, the foot bed member 30 has a plurality of openings 48 which are aligned with the openings 48 formed in toe lug 40 and the heel lug 50. In one embodiment, a bottom surface 101 of each of the toe upper portion 96 and the heel upper portion 98 includes a predetermined number of threaded posts 105 which extend outwardly away from the bottom surface 101. The number of threaded posts 105 is preferably equal to the number of openings 48 formed both in the foot bed member 30 and the toe lug 40 and the heel lug 50. Likewise, the threaded posts 105 are arranged according to the same pattern as the openings 48 so that the threaded posts 105 at least partially extend through the openings 48 of the foot bed member 30 and preferably extend at least partially into the openings 48 of the toe lug 40 and the heel lug 50. The toe upper portion 96, heel upper portion 98, foot bed member 30, toe lug 40 and the heel lug 50 are all attached to one another, in this embodiment, by inserting fasteners into the openings 48 formed in the toe lug 40 and the heel lug 50. The fasteners are then tightened such that they threadingly engage the threaded posts 105. The tightening process is continued until the members are securely attached to one another.

It will be appreciated that this is only one of many different ways of attaching the modular members together. One advantage of the above-described attachment method is that toe and heel lugs 40, 50 are easily detached from the foot bed member 30 and this permits the toe and heel lugs 40, 50 to be changed or replaced as needed. For example, if the skier wishes to increase the gap between the foot bed member 30 and the ski 200 (FIG. 1), the skier simply needs to change the existing toe and heel lugs 40, 50 for ones which have greater heights. The modular design of the ski boot 10 also permits the user to easily change one component if repair or replacement is desired. For example, the user can easily remove the foot bed member 30 from the other modular components and then replace it with another one.

The toe upper portion 96 and the heel upper portion 98 of the boot upper 90 are separated by a clearance 110 defined between a rear end of the toe upper portion 96 and a front end of the heel upper portion 98. This clearance 110 permits the first portion 36 of the foot bed member 30 to pivot with respect to the second portion 38. The clearance 110 is preferably wedge shaped. A narrow end of the clearance 110 is directed downwardly to be adjacent to an in alignment with the hinge 70 on the foot bed member 30, and a wide end of the clearance 110 is directed upwardly to be positioned at a top side of the boot upper 90 opposite the foot bed member 30. The clearance 110 is aligned with the hinge 70 and dimensioned such that when the ski boot 10 is free of the ski binding, the first portion 36 is permitted to pivot with respect to the second portion 38, and thus the toe upper portion 96 of the boot upper 90 correspondingly pivots with respect to heel upper portion 98 of the boot upper 90. With this arrangement, the toe end 12 of the ski boot 10 pivots relative to the heel end 14 of the boot 10 making the boot 10 more comfortable for walking once the skier has released the ski boot 10 from the ski binding and also once the skier has properly adjusted the ski boot 10 to a walking mode as will be described in greater detail hereinafter. One possible method for providing the clearance 110 to a ski boot having a rigid boot upper 90 is to carefully cut and remove a wedge-shaped slice from the wedge shaped clearance 110. One will appreciate that this is also illustrative of a possible method of manufacturing new boots according to the present invention, or a method of retrofitting existing boot constructions to arrive at the present invention. In either case, both front entry and rear boots can be newly manufactured or retrofitted to have a flexible toe according to one embodiment.

With the foot bed member 30 articulated about the hinge 70 and the clearance 110 provided to the boot upper 90, the first portion 36 supporting the toe upper portion 96 of the boot upper 90 may pivot freely above and below a plane 120 (indicated by a broken line in FIG. 20) drawn through the second portion 38. If the first portion 36 of the foot bed member 30 is permitted to pivot below planar alignment with the second portion 38, i.e., below the plane 120, the opposite end of the foot bed member 30 would fold downwardly relative to the hinge 70 and could allow the ski boot 10 to pull free from the binding, causing the unanticipated release of the ski 200 from the ski boot 10. Clearly such unanticipated release is undesirable and when traversing a mountain slope.

Accordingly, to ensure that the ski boot 10 remains secured in the ski binding, means are provided to prevent the first portion 36 of the foot bed member 30 from pivoting below planar alignment with the second portion 38, i.e., below the plane 120. The means may be provided, for example, to the foot bed member 30 or the hinge 70 in the form of a stop member 112 (FIGS. 19–20) that limits pivotal movement of the first portion 36 with respect to the second portion 38. In the example shown in FIGS. 19–20, the member 112 extends in planar alignment from the hinge plate 74 to a position below and in abutting engagement with hinge plate 72 when hinge plate 72 is in planar alignment with hinge plate 74 (FIG. 20). Thus, hinge plate 72 can freely pivot above the planar alignment, i.e., plane 120 but is prevented from pivoting below the planar alignment. The equivalent effect would also be realized if a stop member similar to the stop member 112 were provided to the second portion 38 at a point adjacent to the hinge 70.

Referring to FIGS. 1–8, an articulated truss assembly 130 is provided and functions to lock the first portion 36 with respect to the second portion 38 when the truss assembly 130 is in a first position. When the truss assembly 130 is adjusted to a second position, an unlocking of the first portion 36 occurs. The articulated truss assembly 130 is shown in greater detail in FIGS. 4A–B and the heel upper portion 98 is shown in greater detail in FIG. 4B. The articulated truss assembly 130 includes a truss body 140 having a first end 142, an opposing second end 144, a top surface 146, a bottom surface 148, and side faces 150 between the first end 142 and the second end 144.

The first end 142 of the truss body 140 has a front section 152 which is defined by planar top and bottom surfaces 146, 148. A predetermined number of openings 154 are formed in the front section 152 and extend therethrough from the top surface 146 to the bottom surface 148. The openings 154 are used to attach the first end 142 to an upper surface 97 of the toe upper portion 96 of the boot upper 90. For example, fasteners (not shown) may be inserted into the openings 154 and then into corresponding openings 162 formed in the upper surface 97 of the toe upper portion 96 so as to couple the first end 142 to the toe upper portion 96. Proximate to the first end 142, a spring loaded hinge 160 is provided and extends across the top surface 146 such that the openings 154 are formed between the spring loaded hinge 160 and the first end 142. The truss body 140 has a pair of pronounced side flanges 156 which extend upwardly above the top surface 146 of the truss body 140. The spring loaded hinge 160 preferably extends across the side flanges 156 and permits the second end 144 of the truss body 140 to pivot relative to the first end 142 under select conditions, as will be described in greater detail hereinafter. In other words, the spring loaded hinge 160 permits the truss body 140 to be adjusted between the first (locked) and second (unlocked) positions.

As mentioned, the first end 142 of the truss body 140 is coupled to the upper surface 97 of the toe upper portion 96. Preferably, the upper surface 97 has a contoured, slightly recessed platform 99 which is shaped to intimately receive the first end 142 of the truss body 140. More specifically, the contoured, recessed platform 99 has a shape which is complementary to the first end 142. In one exemplary embodiment, the platform 99 extends to a rear upper edge 101 of the toe upper portion 96. The rear upper edge 101 partially defines the wide end of the wedge shaped clearance 110.

Figure 4A:
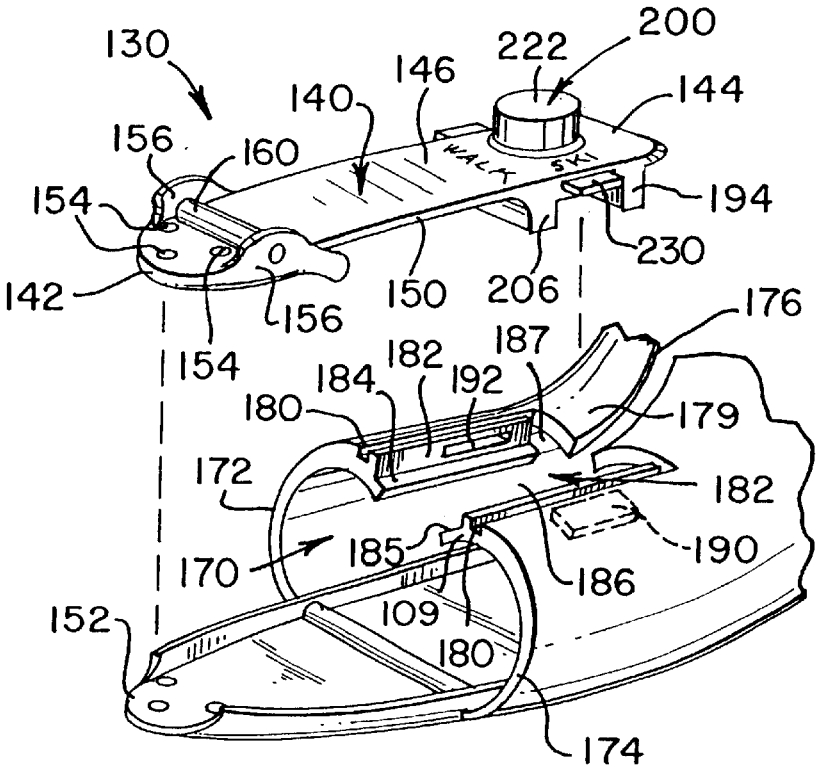
FIG. 4A is an exploded perspective view showing an articulated truss assembly according to the present invention and for use in the ski boot of FIG. 1.
Figure 4B:
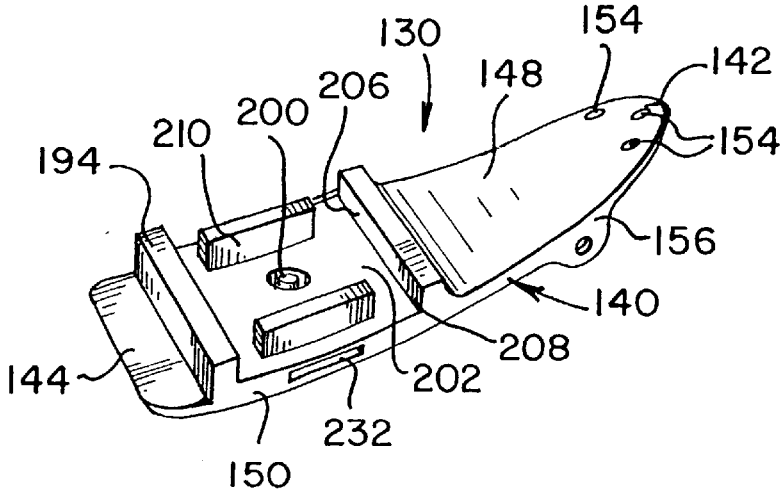
FIG. 4B is a bottom perspective view of the articulated truss assembly of FIG. 4A.

As best shown in FIGS. 1 and 4A and 4B, the second end 144 of the truss body 140 is selectively locked to a truss section 170 of the heel upper portion 98. The heel upper portion 98 generally is formed of two opposing sections 172, 174 with a gap 176 extending between the two sections 172, 174. The heel upper portion 98 is preferably formed of a rigid plastic material suitable for use as a ski boot shell material. Side edges of the two sections 172, 174 are curved so as to properly accommodate the skier's foot, as best shown in FIG. 4A. The gap 176 permits the two sections 172, 174 to be slightly opened relative to one another to provide the skier with sufficient room to place his/her foot therein. While the heel upper portion 98 is formed of a rigid material, it has some resiliency permitting the two sections 172, 174 to be slightly opened and once the force that is needed to separate the sections 172, 174 is removed, the sections 172, 174 will close and move toward one another as they return to their original shape and position due to their resiliency. One advantage of the ski boot 10 is that it offers an attractive alternative to conventional front entry ski boots because the skier simply resiliently separates sections 172, 174 from one another and the skier then places his/her foot into the ski boot 10. This is much easier than conventional front entry ski boots having overlapping forefront flange configurations.

An upper surface 103 of the heel upper portion 98 is open at the truss section 170 with the gap 176 leading into the opening formed in the upper surface 103 at a front end 109 thereof. More specifically, the truss section 170 includes a pair of spaced guide grooves 180 which extend longitudinally from the front end 109 to a rear wall 179 of the truss section 170 with the rear wall 179 being formed by the first and second sections 172, 174. The grooves 180 are generally parallel to one another and are open at least at one end thereof (the front end 109). The grooves 180 are defined in part by two facing walls 182. Between the walls 182, a pair of flanges 184 are provided. The flanges 184 are formed perpendicular to the walls 182 and extend toward one another. However, the flanges 184 do not contact one another and thereby define a space 186 there between. Because each flange 184 is generally perpendicular to one respective wall 182, a shoulder 185 is formed. The walls 182 and the flanges 184 do not extend completely to the rear wall 179 such that a gap 187 is formed between the ends of the walls 182 and the flanges 184.

The truss section 170 also has a pair of opposing flange compartments 190 formed in the first and second sections 172, 174. Each flange compartment 190 has an entrance 192 which is formed in a side face of the wall 182 and opens into the space 186. The compartment 190 lies within a plane which is generally parallel to the plane containing the flanges 184 and is likewise generally perpendicular to latitudinal planes containing the grooves 180. In the exemplary embodiment, the compartment 190 has a substantially rectangular shape; however, it will be understood that it may have any number of shapes. The flange compartments 190 are preferably formed so that they are directly opposite one another.

The truss body 140 is designed to selectively lock with the truss section 170 of the heel upper portion 98. The bottom surface 148 of the truss body 140 has a transverse lip 194 which is received in the gap 187 formed at the ends of the walls 182 and flanges 184 when the second end 144 of the truss body 140 is locked into place using the locking mechanism 200. A portion of the bottom surface 148 is cut away such that a recessed platform 202 is formed. The recessed platform 202 is defined at one end by the lip 194 and at an opposite end by a forward butt wall 206 which is generally perpendicular to the recessed platform 202 such that a shoulder 208 is formed. The forward wall 206 is preferably parallel to the lip 194 and upper edges of the forward wall 206 and the lip 194 preferably lie in the same plane.

Between the lip 194 and the forward wall 206, a pair of tabs 210 are formed on the platform 202. The tabs 210 extend upwardly away from the platform 202 toward the upper edges of the forward wall 206 and the lip 194. Each of the tabs 210 has a predetermined height such that a plane containing the upper edges of the tabs 210 lies below the plane containing the upper edges of the lip 194 and the forward wall 206 in the orientation of FIG. 4B. The tabs 210 are arranged on the platform 202 so that when the second end 144 of the truss body 140 is locked in place, the tabs 210 are received within the guide grooves 180. The tabs 210 are thus spaced appropriately apart so that they are received within the guide grooves 180. The tabs 210 do not extend completely from the lip 194 to the forward wall 206 but rather a first space is formed between first ends of the tabs 210 and the lip 194 and a second space is formed between second ends of the tabs 210 and the forward wall 206. In the exemplary embodiment, the tabs 210 have a rectangular cross section. The tabs 210 are shaped and sized so that a secure frictional fit results between the tabs 210 and the grooves 180. By disposing the tabs 210 within the grooves 180, the lateral movement of the truss body 140 is restricted due to the intimate fit of the tabs 210 within the grooves 180. It will be appreciated that an alterative locking guide arrangement can be used. For example, instead of using tabs 210, one or more guide protrusions can be used to functionally engage complementary shaped guide recesses. The reception of protrusions in the guide recesses serves to locate the truss body 140 relative to the truss section 170. As with the previously-mentioned arrangement, this engaging relationship prevents undesired lateral movement.

In the locked position, the lip 194 is securely received within the gap 187 with the rear wall 179 abutting against the lip 194. Accordingly, the dimensions of the gap 187 and the dimensions of the lip 194 are similar such that the lip 194 is intimately received within the gap 187 and a portion of the lip 194 extends below the flanges 184. Because the lip 194 is in abutting relationship with the rear wall 179 and a portion of the lip 194 extends below the flanges 184 in the locked position, a forward shift of the ski boot 10 is prevented when the ski boot 10 is in a ski mode. This ensures that the toe upper portion 96 does not move forward, thereby opening the clearance 110. Similarly, the forward wall 206 is placed in abutting relationship with the front edge 109 of the heel upper portion 98 when the truss body 140 is in the locked position. This arrangement prevents a rearward shift of the ski boot 10 during use of the ski boot 10 in the ski mode. This ensures that the toe upper portion 98 does not move rearward, thereby opening the clearance 110.

The locking mechanism 200 of the articulated truss assembly 130 serves to selectively lock the truss body 140 to the heel upper portion 98 and more specifically, to the truss section 170 thereof. In one exemplary embodiment, the locking mechanism 200 includes an adjustable knob 222 which permits the skier to lock the second end 144 of the truss body 140 by moving the knob 222 to a first locked position. Similarly, the skier can disengage the second end 144 of the truss body 140 from the truss section 170 by adjusting the knob 222 to a second unlocked position. Preferably, indicia is formed on the top surface 146 of the truss body 140 to indicate the locations of the of the first and second positions. For example, the word "ski" may be used as representing the first locked position and the word "walk" may be used as representing the second unlocked position. While, FIG. 4A. shows the two positions as being approximately 90° apart, this is only exemplary and it will be appreciated that the two positions may be arranged differently, i.e., 180° apart from one another.

The knob 222 extends outwardly away from the top surface 146 of the truss body 140 and has a sufficient height so that the skier may easily grip and turn the knob 222 to one of the first locked and second unlocked positions. Preferably, the knob 222 is centrally located on the top surface 146. The locking mechanism 220 is best illustrated in FIGS. 4A–B. In addition to the knob 222, the locking mechanism 220 includes a pair of cam activated locking flanges 230 which are operatively coupled to the knob 222 so that adjustment of the knob 222 causes either retraction or extension of the cam activated locking flanges 230. More specifically, the cam activated locking flanges 230 are adjustably disposed within cavities 232 formed in the side faces 150. The cavities 232 are formed in the truss body 140 at least partially underneath a section of the tabs 210. Locking flanges 232 prevent lateral separation of left and right sides of the forefront when the ski boot 10 is in the ski mode. It will be appreciated that other members may be used instead of locking flanges 232 so long as the members lock the truss assembly in place and prevent lateral movement between the truss member and the boot upper 90.

Figure 6:
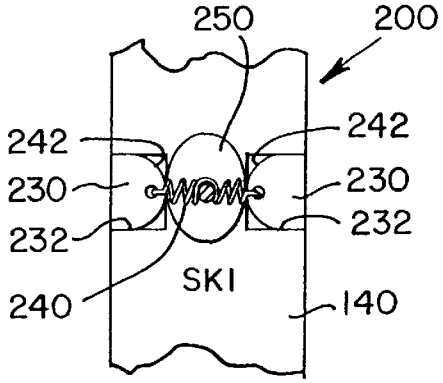
FIG. 6 is a partial cross-sectional view of the truss body of FIG. 5 illustrating the locking flanges in a retracted position.

FIGS. 4B and 6 show the locking flanges 230 in a retracted position such that the locking flanges 230 are completely disposed within the cavities 232 and do not extend beyond the side faces 150. In this retracted position, the truss body 140 can mate with the truss section 170 of the heel upper portion 98 in order to lock the second end 144 of the truss body 140 to the truss section 170. When the locking flanges 230 are retracted, the second end 144 is free to mate with the truss section 170 with the lip 194 being received in the gap 187 and the side faces 150 of the truss body 140 intimately abutting against the walls 182. The cavities 232 are formed at locations in the side faces 150 so that when the sides faces 150 seat against the walls 182, the cavities 232 align with the flange compartments 190. This permits the cam activated locking flanges 230 to be disposed within the flange compartments 190 when the skier appropriately adjusts the knob 222 to the first locked position. Accordingly, the locking flanges 230 are sized and shaped in a complementary manner relative to the flange compartments 190.

Figure 5:
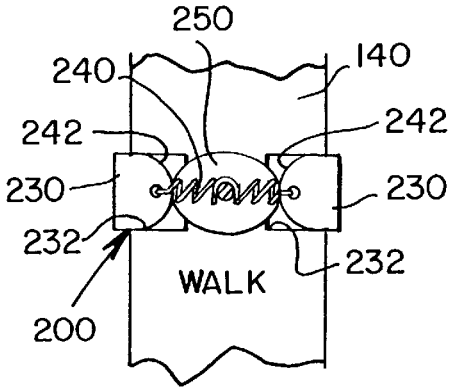
FIG. 5 is a partial cross-sectional view of a truss body illustrating a locking mechanism thereof with locking flanges being in an extended position.

FIGS. 5 and 6 are cut away views of the truss body 140 showing the locking mechanism 200 in more detail. FIGS. 4A and 5 shows the locking mechanism 200 in the first locked position (ski mode) and FIGS. 4B and 6 show the locking mechanism 200 in the second unlocked position (walk mode). As shown, a cam member 250 is disposed within the truss body 140 between the cavities 232 and in the exemplary embodiment, the cam member 250 is an elliptical shaped member. The cam member 250 is connected to the knob 222 so that adjustment of the knob 222 causes the cam member 250 to move (rotate). The locking flanges 230 are loaded by attaching each flange 230 to a common biasing member 240. In one exemplary embodiment, the biasing member 240 is a spring which is attached to an inner edge 242 of each locking flange 230. As shown in FIG. 6, in the unlocked position, the cam member 250 is vertically position so that the cam member 250 does not act upon or only slightly acts upon the locking flanges 230. Because the flanges 230 are biased toward one another by the spring member 240 when no forces act upon the flanges 230, the flanges 230 are drawn toward one another and assume a retracted position within the cavities 232. In this retracted position, the flanges 230 do not extend beyond the side faces 150 of the truss body 140 and the truss body is free to be inserted into the truss section 170 of the heel upper member 98.

FIG. 5 shows the first locked position of the locking mechanism 200, whereby the user (skier) has moved the knob 222 (FIG. 4A) to the first position (ski mode). As the user moves the knob 222 from the second position (walk mode) to the first position, the cam member 250 coupled thereto begins to rotate within the truss body 140. As the cam member 250 rotates, it contacts the inner edges 242 of the flanges 230 causing the flanges 230 to be displaced laterally toward the side faces 150. In other words, the elliptical shape of the cam member 250 and the rotation thereof forces the flanges 230 apart from one another by overcoming the biasing force of the spring member 240. This results in the locking flanges 230 being driven out of the cavities 230 and into the flange compartments 190 which are aligned with the cavities 230. By disposing the locking flanges 230 into the flange compartments 190, the truss body 140 is locked into place within the truss section 170 of the heel upper portion 98. The cam member 250 is configured so that it remains in the first locked position (ski mode) shown in FIG. 5 as the user skies.

When the user desires to go from the ski mode to the walk mode, the user simply adjusts the knob 222 from the first locked position to the second unlocked position. As the user adjusts the knob 222 in this manner, the cam member 250 rotates from its longitudinal position to a more latitudinal position. This results in less and less force being applied by the cam member 250 on the inner edges 242 of the flanges 230 and therefore, less force is being applied to overcome the biasing force of the spring member 240. The locking flanges 230 begin to retract within the cavities 232 until the cam member 250 assumes its latitudinal position where it exerts no force or very little force against the flanges 230. It is in this position that the spring member 240 is at a rest position and the locking flanges 230 are retracted and held within the cavities 232 so that they do not extend beyond the side faces 150.

In this walk mode and as soon as the second end 144 of the truss body 140 is released from the truss section 170, the spring hinge 160 near the first end 142 of the truss body 140 causes the second end 144 of the truss body 140 to be lifted a predetermined distance from the upper surface 103 of the heel upper portion 98. In other words, the truss body 140 is biased upwardly by the spring hinge 160 so that once the second end 144 is disengaged from the truss section 170, the second end 144 lifts upwardly and clears the upper surface 103 of the heel upper portion 98. Because the toe upper portion 96 is no longer locked in place relative to the heel upper portion 98, the toe upper portion 96 is free to pivot about the hinge 70. This permits the toe end 12 of the ski boot 10 to pivot relative to the heel end 14 of the ski boot 10, making the boot more comfortable for walking once released from the ski binding.

As with most currently available ski boots, the ski boot 10 of the present invention has a flexible, soft inner bladder 260, shown best in FIG. 3. The inner bladder 260 is received within the boot upper 90 and the cuff 94 and seats against a bottom surface of the toe upper portion 96 and the heel upper portion 98. The inner bladder 260 is formed of a suitable material which is commonly used to make such ski boot component and typically is formed of a material that offers excellent water repellant properties as well as warmth.

Figure 7:
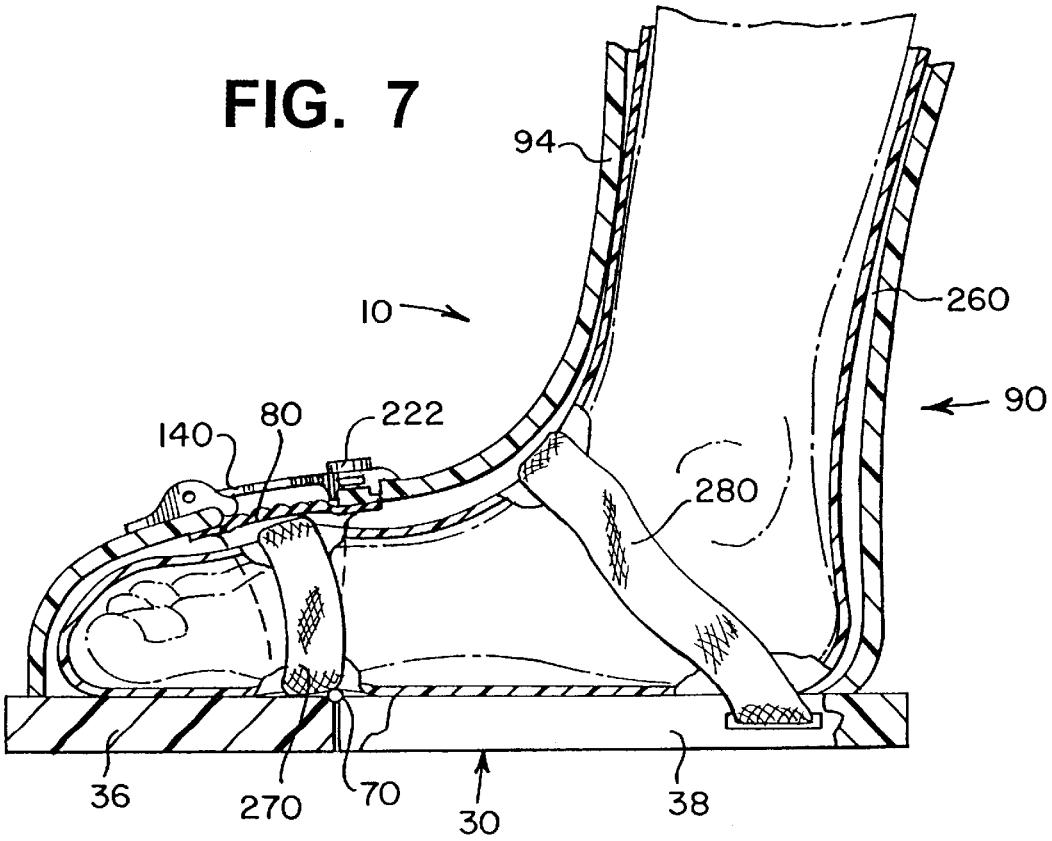
FIG. 7 is a cross-sectional side view of the ski boot of FIG. 1 in a planar ski position and showing a skier's foot disposed therein and adjustable forefoot and ankle straps used to securely hold the foot within the boot.
Figure 8:
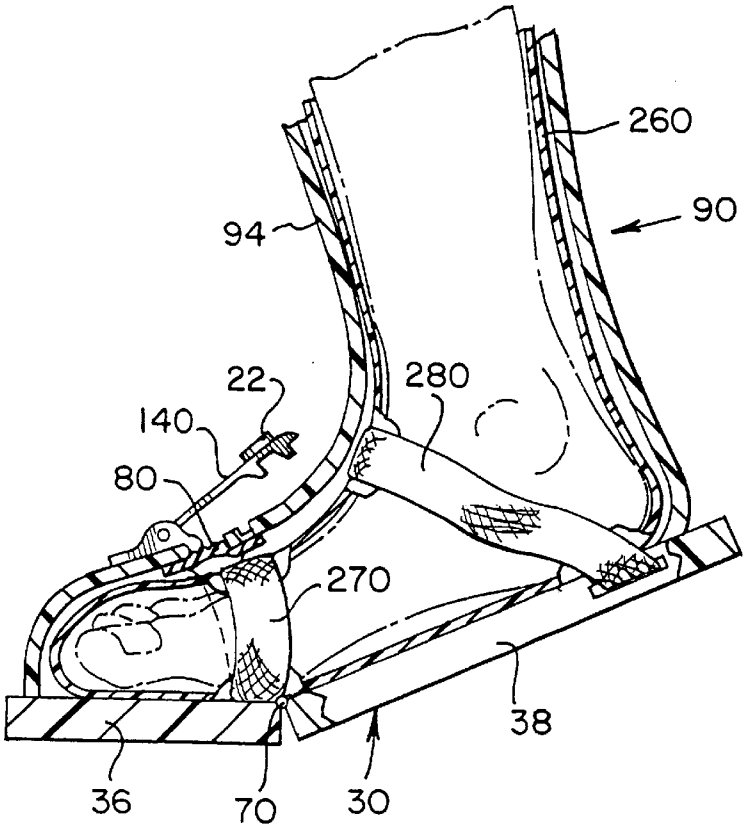
FIG. 8 is a cross-sectional side view of the ski boot of FIG. 1 in a non-planar walking position showing the bending of the skier's foot and the accommodation of the ski boot thereto.

Referring to FIGS. 1–18, in another aspect of the present invention, the ski boot 10 has a first adjustable internal member 270 and a second adjustable internal member 280 both of which are disposed around a selected portion of the soft inner bladder 260 as best shown in FIGS. 7–8. More specifically, the first adjustable internal member 270 is positioned at the forefront of the skier's foot and the second adjustable internal member 280 is positioned generally at the ankle or heel of the skier. In one exemplary embodiment, each of the first and second adjustable internal members 270, 280 comprises a durable strap, e.g., a strap formed of a natural or synthetic material, i.e., nylon. FIG. 7 is a cross-sectional side view showing the first and second straps 270, 280 disposed between the inner bladder 260 and the upper boot 90 and the relative positions of the first and second straps 270, 280 with respect to the skier's foot. FIG. 7 shows the ski boot 10 in the first locked position (ski mode) while FIG. 8 shows the ski boot 10 in the second unlocked position (walk mode).

As shown in FIG. 7, when the ski boot 10 is in the first locked position, the first strap 270 is disposed generally underneath the truss body 140 within the clearance 110 formed between the toe upper portion 96 and the heel upper portion 98. The first strap 270 is thus generally disposed proximally above the hinge 170. The protective membrane 80 (e.g., a soft rubber accordion member) is disposed over the first strap 270 so as to protect the first strap 270 and prevent interference between the first strap 270 and other items, including the lockable truss body 140 and the skier's hand. FIG. 8 shows the ski boot 10 after the truss body 140 has been unlocked by manipulating the knob 222. As previously described, this unlocking action causes the second end 144 of the truss body 140 to be biased upwardly away from the upper surface 103 of the heel upper portion 98. In this walk mode, the toe upper portion 96 and the heel upper portion 98 are not rigidly held in planar arrangement relative to one another and the action of the hinge 70 permits the to walk as the toe upper portion 96 is free to pivot relative to the heel upper portion 98. Again in this mode, the protective membrane 80 covers and protects the first strap 270 and the accordion-like nature of the membrane 80 permits this member to contract and expand as the skier walks in the ski boot 10.

FIGS. 7–18 illustrate in detail how the first and second straps 270, 280 are held in place within the ski boot 10 and also adjusted by the skier. For purposes of simplification, only the first strap 270 will be described and it will be understood that the second strap 280 is held within the ski boot 10 in the same manner as the first strap 270. Likewise, the second strap 280 is adjusted in the same manner as the first strap 270. The first strap 270 has a first end 272 and an opposing second end 274. In one embodiment, the ski boot 10 has a first strap retaining member 290 and a second strap retaining member 300 each of which is preferably disposed within the foot bed member 30 itself. In the case of the first strap 270, the first and second strap retaining members 290, 300 are disposed in the first portion 36 of the foot bed member 30, while the first and second strap retaining members 290, 300 for the second strap 280 are disposed in the second portion 38.

Figure 11:
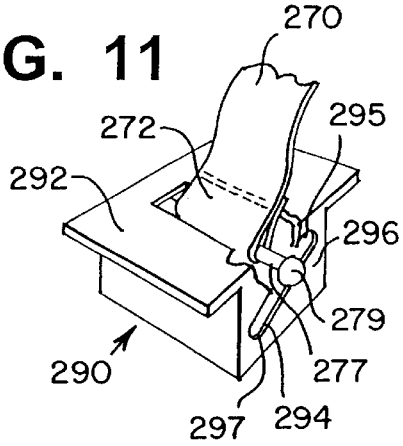
FIG. 11 is a perspective view of a fixed strap retaining member for fixing another end of one of the forefront and ankle straps within an interior of the ski boot.

In one embodiment, the first strap retaining member 290 is a fixed box-like member recessed within the first portion 36 of the foot bed member 30. FIG. 11 shows an enlarged view of the first strap retaining member 290. The member 290 has an upper surface 292 which preferably lies flush with the upper surface of the foot bed member 30 and also includes a pair of opposing diagonal slots 294 formed in side walls 296 of the member 290. Preferably, the first strap retaining member 290 is disposed on an inner side of the foot bed member 30 with the inner side of one ski boot 10 being the side that faces the other ski boot 10. The first end 272 is secured to the first member 290 by a slidable pin 277 which is attached to the first end 272 along a central portion thereof. The pin 277 is disposed within the slots 294 and head portions 279 of the pin 277 prevent the pin 277 from being removed from the slot 294. The pin 277 is permitted to slide within the slots 294 and this acts as a self adjusting mechanism. The slots 294 have upper ends 295 and lower ends 297 and the pin 277 is free to travel between the upper ends 295 and the lower ends 297. The pin 277 travels within the slots 294 depending upon a number of factors, including the movements of the skier's foot within the ski boot 10 underneath the strap 270 and the size of the skier's foot. For example, if the skier has a wide foot, the placement of the foot within the inner bladder 260 forces the strap 270 outwardly and the pin 277 slides toward the lower ends 297 of the slots 294. In contrast, if the skier's foot has a small width, the pin 277 slides toward the upper ends 295 of the slots 294.

Figure 12:
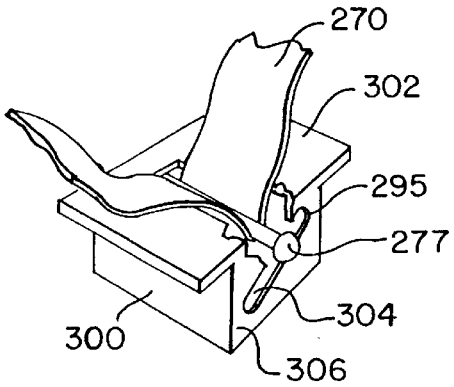
FIG. 12 is a perspective view of a looped strap retaining member which guides one of the forefront and ankle straps to the adjusting mechanism.
Figure 13:
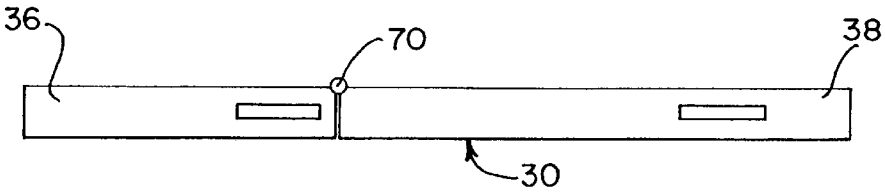
FIG. 13 is a cross-sectional end view of a foot bed member of the ski boot illustrating the location of the fixed and looped strap retaining members.

The second strap retaining member 300 is a fixed box-like member also recessed within the first portion 36 of the foot bed member 30. FIG. 12 shows an enlarged view of the second strap retaining member 300. The member 300 has an upper surface 302 which preferably lies flush with the upper surface of the foot bed member 30 and also includes a pair of opposing diagonal slots 304 formed in side walls 306 of the member 300. Preferably, the second strap retaining member 300 is disposed on an outer side of the foot bed member 30 with the outer side of one ski boot 10 being the side that faces away from the other ski boot 10. The first strap 270 is looped around the slidable pin 277 which rides within the slots 304 with head portions 279 of the pin 277 preventing the pin 277 from being removed from the slot 304. The pin 277 acts as a self adjusting mechanism as it is free to travel between upper ends 303 and lower ends 305 of the slots 304 depending upon the shape space of the skier's foot and movements of the skier's foot. The first strap 270 is inserted into an opening formed in the member 300 and then is disposed underneath the pin 277 to form a looped construction as the first strap 270 then exits the second member 300.

Figure 10:
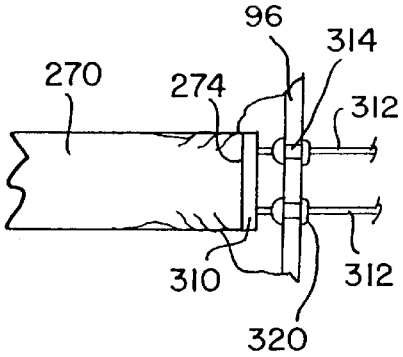
FIG. 10 is a cross-sectional end view partially showing the attachment of one end of the strap to cables of the adjusting mechanism.

As best shown in FIG. 10, the second end 274 of the first strap 274 is attached to a rigid bar 310 which extends across the second end 274. The rigid bar 310 is disposed on the inside of the toe upper portion 96 after the first strap 274 has been looped through the second member 300 (FIG. 12). The first strap 274 may be attached to the rigid bar 310 by any number of techniques, including using an adhesive or other fasteners. Because of the rigidity of the bar 310, the shape of the second end 274 is maintained. A pair of cables 312 are coupled to the rigid bar 310 so that the cables 312 are spaced apart across the rigid bar 310. The pair of cables 312 extend through openings 314 formed in the sides of the toe upper portion 96 so that the cables 312 communicate with the exterior of the ski boot 10. The openings 314 are dimensioned as small as possible without causing any restriction of the cables 312 during use. The cables 312 may be formed of any suitable material and in one exemplary embodiment, the cables 312 are formed of a synthetic material, e.g., nylon. Preferably, the cables 312 are formed of a non-corrosive monofilament material, such as nylon fibers.

Figure 9:
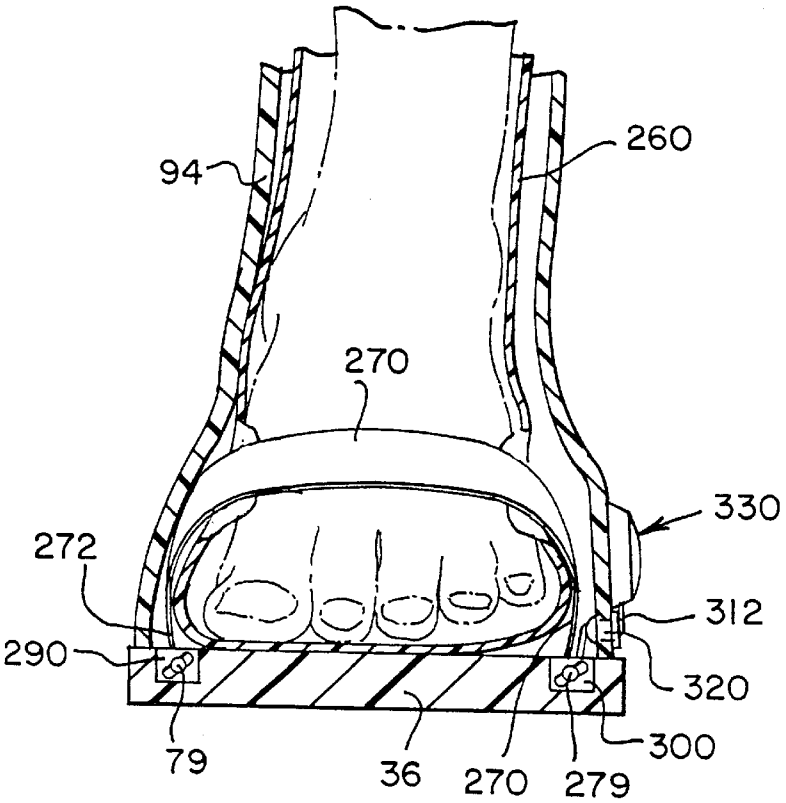
FIG. 9 is a cross-sectional end view showing the adjustable forefoot strap and a mechanism for adjusting the forefoot strap.

As best shown in FIGS. 9 and 10, the cables 312 are preferably fed through gasket or seal members 320 which act to insulate the openings 314 formed in the toe upper portion 96. This is beneficial as it is desirable to prevent cold air from entering into the interior of the ski boot 10 through these openings 314 and it is also desirable to keep precipitation out from the interior also. Likewise, the gasket members 320 prevent heat loss from within the boot upper 90.

Figure 14:
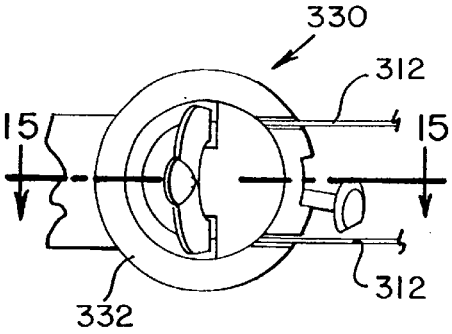
FIG. 14 is a top plan view of a thumbscrew device of the adjusting mechanism with a handle being in an open position.
Figure 17:
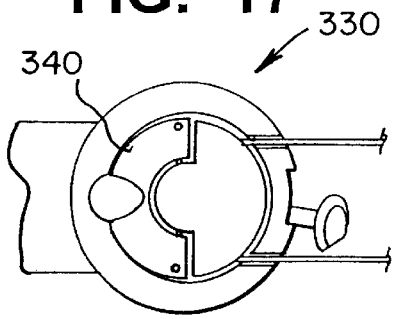
FIG. 17 is a top plan view of the thumbscrew device of FIG. 14 showing the handle in a closed position.

Once the cables 312 clear the toe upper portion 96, the cables 312 are connected to a thumbscrew device 330 which permits the skier to either tighten or loosen the first strap 270 around the forefoot of the skier. FIG. 14 is a top plan view of the thumbscrew device 330 with a handle 340 thereof being in a first open position, while FIG. 17 is a top plan view showing the handle 340 in a second closed position. The thumbscrew device 330 includes a body 332 having a rotatable member 334 operatively connected at a top portion thereof. The rotatable member 334 includes the handle 340 which is easily position between the first closed position and the second open position by simply lifting the handle 340 upward into the depicted second open position. In this open position, the skier may freely grasp a portion of the handle 340 to effectuate rotation thereof. The rotatable member 334 also includes a handle base portion 342 to which the handle 340 is pivotally attached and therefor, the base portion 342 rotates along with the handle 340.

Figure 15:
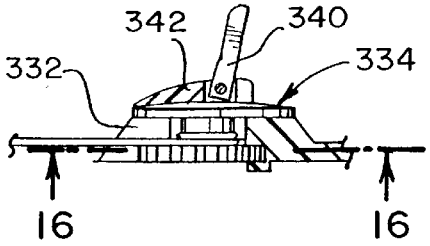
FIG. 15 is a cross-sectional view taken along the line 15—15 of FIG. 14.
Figure 16:
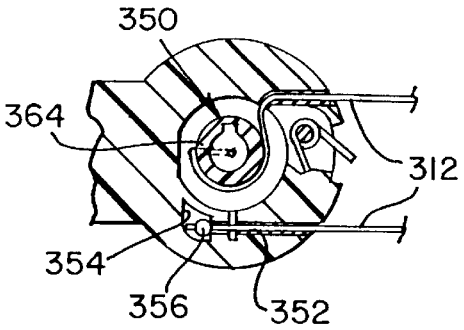
FIG. 16 is a cross-sectional view taken along the line 16—16 of FIG. 15.
Figure 18:
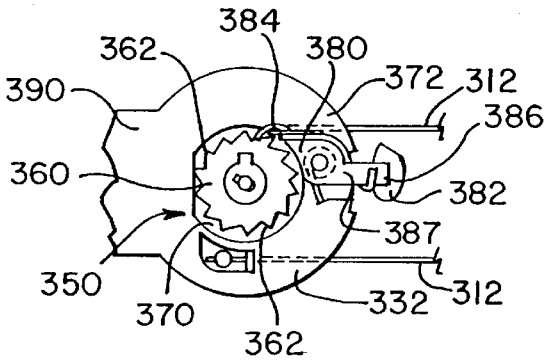
FIG. 18 is a bottom plan view of the thumbscrew device of FIG. 14 showing a ratchet mechanism thereof.

FIG. 15 is a cross-sectional side view showing the thumbscrew device 330 and FIG. 16 is yet another cross-sectional view taken from FIG. 15 showing the internal ratcheting mechanism 350 of the device 330. Finally, FIG. 18 is a bottom plan view of the thumbscrew device 330 showing the internal ratchet mechanism 350 along with the other working components of the device 330. As can be seen in the Figs., one of the cables 312 is fixedly attached within the body 332. This one cable 312 is fed into the body 332 through a first channel 352 which communicated with a first compartment 354 formed in the body 332. An end of this cable 312 is held within the first compartment 354 using known techniques, such as placing a stopper 356 on this end, thereby preventing the cable 312 from being pulled through the first channel 352 away from the first compartment 354. In the illustrated embodiment, the stopper 356 is a member which is attached to the end of the cable 312 and includes greater dimensions than the dimensions of the first channel 352. Because of the difference in dimensions, the stopper 356, along with the end of the cable 312 attached thereto, is prevented from being pulled through the first channel 252.

The other cable 312 is a ratcheting cable which is either wound or unwound by action of the ratchet mechanism 350. The ratchet mechanism 350 includes a ratchet wheel 360 operatively connected to the rotatable member 334, e.g., by use of a common shaft. The ratchet wheel 360 has a number of radially arranged teeth 362 and is disposed within a recessed cavity 370 formed in the underside of the body 332. As best shown in FIG. 18, the other cable 312 is fitted through a second channel 372 formed in the body 332 with one end of the other cable 312 being attached to an upper portion 364 of the ratchet wheel 360. The upper portion 364 is preferably annular in nature so as to facilitate the winding and unwinding of the cable 312 around the upper portion 364. It will be appreciated that the second channel 372 is formed so as to feed the other cable 312 into the ratchet mechanism 350 at a location above the ratchet wheel 360. In other words, the other cable 312 is attached to the upper portion 364 of the ratchet wheel 360 above the teeth 362 so as to avoid any interference with the ratcheting action of the teeth 362. The first and second channels 352, 372 are generally parallel to one another.

The ratchet mechanism 350 also includes a pawl 380 with a lever 382 attached thereto. The pawl 380 has a first end 384 that engages the teeth 362 of the ratchet wheel 360 to hold the wheel 360 in a given position. A second end 386 of the pawl 380 attaches to the lever 382, which preferably comprises a knob for grasping by the user. The size and shape of the first end 384 are complementary to the shape and spacing of the teeth 362 so that the first end 384 is capable of being disposed between adjacent teeth 362 during the ratcheting action to prevent movement of the ratchet wheel 360 in one direction. The pawl 380 is biased by a spring 387 so that the first end 384 is spring biased toward the ratchet wheel 360 and more specifically, the first end 384 is spring biased against the teeth 362 of the ratchet wheel 360. Thus, as the user rotates the rotatable member 350, the ratchet wheel 360 rotates with the first end 384 of the pawl 380 successively engaging the teeth 362 to prevent counter-rotation of the ratchet wheel 360.

To release the pawl 380 from engagement with the ratchet wheel 360, the user simply grasps the lever 382 at the second end 386 and moves the lever 382 in a direction toward the one fixed cable 312. As the biasing force applied by the spring 387 is overcome, the first end 384 disengages from the teeth 362 and this action permits the free rotation of the rotatable member 334 including the ratchet wheel 360 coupled thereto. As shown in FIG. 18, the pawl 380 is conveniently located in a compartment formed on the underside of the body 332. Preferably, the underside of the body 332 is planar so that it can seat flush against a given surface.

As shown in FIGS. 1 and 9, the thumbscrew device 330 is attached to the outer surface of the toe upper portion 96 and preferably is located on the inner side thereof which faces the other ski boot 10. The thumbscrew device 330 may be attached to the toe upper portion 96 using any number of conventional techniques. In one embodiment, the thumbscrew device 330 is attached to the toe upper portion along a hinge 390. The hinge 390 may be entirely or partially integrally formed with the toe upper portion 96 or the hinge 390 may be attached to the toe upper portion 96 using a fastener or the like. By hingedly attaching the thumbscrew device 330 to the toe upper portion 96, an end of the device 330 closest to the lever 382 may be lifted, thereby permitting the ratchet mechanism 350 to be visually observed. This allows the ratchet mechanism 350 to be easily maintained (cleaned) and if there are any working difficulties, the user can try to discover the problem by looking at the working components of the ratchet mechanism 350.

The thumbscrew device 330 acts to tighten the first strap 270 by rotating the rotatable member 334 in the ratcheting direction. As the ratchet wheel 360 is rotated, the cable 312 attached to the upper portion 364 of the ratchet wheel 360 begins to wind around the upper portion 364. This causes a tightening of the first strap 270 around the skier's foot contained within the inner bladder 260 due to the first strap 270 being drawn through the looped second member 300 and the second end 274 being pulled toward the toe upper portion 96. Conversely, the skier can loosen the first strap 270 by moving the lever 382 so that the first end 384 of the pawl 380 disengages from the teeth 362 of the ratchet wheel 360, thereby releasing the ratchet wheel 360. Once the ratchet wheel 360 is released, the first strap 270 may be freely moved, i.e., the skier can loosen the first strap 270 to achieve greater comfort or to permit the skier's foot to be removed from the ski boot 10. The first strap 270 freely moves because the ratchet wheel 360 and the rotatable member 334 freely rotate themselves causing the one cable 312 to unwind (which loosens the first strap 270). This permits any tension built-up in the ratcheting mechanism 350 to be released.

One will appreciate that the second strap 280 performs a similar function with the exception that the second strap 280 holds the heel of the skier to the upper surface of the foot bed member 30 at the heel portion thereof. The second strap 280 is thus retained within the interior of the heel upper portion 98 using the first and second strap retaining members 290, 300. A thumbscrew device 330 is used to adjust cables 312 which are coupled to the second strap 280 to cause either the winding or unwinding of at least one of the cables 312. After the skier has placed his/her foot in the inner bladder 260, the skier then adjusts each of the thumbscrew devices 330 until both the forefoot and the heel of the skier's foot are firmly seated against the upper surface. In other words, both forefoot lift or angulation and heel lift or angulation within the boot upper 90 are prevented by the construction of the ski boot 10 of the present invention.

The tightening and loosening of the first and second straps 270, 280 are easily accomplished due to the fact that two thumbscrew devices 330 are located external to the inner compartment holding the skier's foot. To tighten one of the straps 270, 280, the skier simply needs to reach down and open the respective handle 340 and then turn the handle 340 so that a ratcheting action results causing at least one of the wires 312 to wind up, thereby tightening the respective strap 270, 280. To loosen the respective strap 270, 280, the skier simply disengages the pawl 380 from the ratchet wheel 360. This requires only a simple action by the skier, i.e., moving the lever 382.

Figure 21:
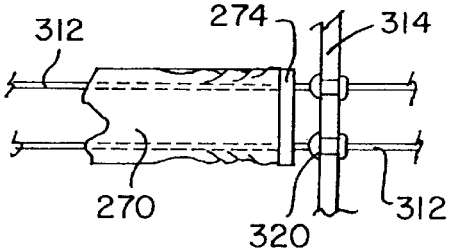
FIG. 21 is a cross-sectional end view partially showing a foot retaining strap according to another embodiment with cables of the adjusting mechanism running at least partially therethrough.

It will further be appreciated that the manner of linking the first and second straps 270, 280 to respective thumbscrew devices 330 may be accomplished using techniques other than the use of rigid bars 310. For example and as shown in FIG. 21, the cables 312 may be at least partially disposed within each of the first and second straps 270, 280 with ends of the cables 312 being attached along an inner surface of each of the first and second straps 270, 280. The cables 312 are still thread through the openings 314 and the gasket or seal members 320. In this embodiment, when at least one of the cables 312 is wound by the ratcheting mechanism 350, the respective strap 270, 280 begins to bunch up along fold lines as it is tightened and due to its proximity to the hard shell of the upper boot 90. It will be appreciated that there are other techniques which can be used to effectuate the tightening and loosening of the straps 270, 280 based on the movements of the cables 312. It will be further appreciated that other tightening devices may be used in place of thumbscrew devices 330. Any externally mounted tightening devices that can tighten and loosen the straps 270, 280 may be used.

Figure 22:
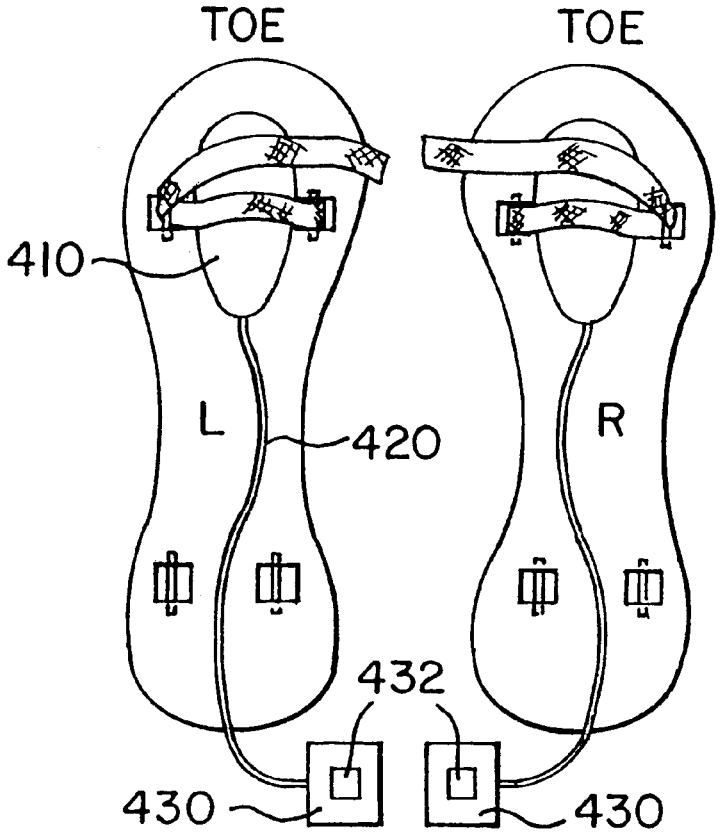
FIG. 22 is a cross-sectional view showing yet another aspect of the present invention where a heating assembly is incorporated into the ski boots.

FIG. 22 shows an optional device that may be incorporated into the ski boot 10. More specifically, a heater device 400 is provided and includes a heating element 410, a conductive wire 420 and an energy source and control unit 430. The heater device 400 is primarily incorporated into the foot bed member 30 of the ski boot 10 and is designed to permit the skier to selectively heat the interior of the ski boot 10 underneath the skier's feet. The heating element 410 is a conventional heating element which typically will have a series of heating coils contained within a body. As soon as electricity is delivered to the coils, current flows through the coils causing them to heat up and emit heat to the surrounding area, which in this case is the interior of the ski boot 10. The heating element 410 is preferably disposed within the foot bed member 30 and should be located near the toe end thereof.

The surface area of the heating element 410 should be sufficient enough to heat a majority of the forefoot area. As is known by most skiers, toes tend to be the area of the feet which are prone most to the cold. The conductive wire 420 serves to deliver current to the heating element 410 with the conductive wire being connected at one end to the heating element 410 and at another end to the energy source and control unit 430. The unit 430 is positioned where a user may at least partially access a portion thereof to turn the unit 430 on and off. The unit 430 preferably includes a switch 432 for accomplishing such on and off operation. In one embodiment, the unit 430 forms a part of or is attached to the upper cuff 94. For example, when the unit 430 attaches to the upper cuff 94, the wire 420 exits the heel end of the foot bed member 30 and then is delivered upwardly along the upper cuff 94 such to a location where the unit 430 attaches. The unit 430 may be detachably secured to the cuff 94 using any number of know techniques, including the use of fasteners and the use of a slotted retaining compartment formed as part of the cuff 94 for holding the unit 430. The energy source is preferably a conventional battery.

To turn the unit 430 on and supply heat to the skier's feet, the switch 432 is moved to the on position and current flows from the energy source through the wire 420 to the heating element 410. To turn it off, the switch 432 is moved to the off position. Preferably, the wire 420 is formed of two sections with a connector 421 being provided to electrically connect the two sections. The use of a connector 421 is preferred because once the battery becomes drained, the battery (control unit 430) is simply replaced by unplugging the two wire sections from one another and then plugging a wire section associated with a new battery (control unit 430) into the wire section permanently disposed in the foot bed member 30.

In the instance where the unit 430 is part of the cuff 94, it may contain a housing integrally formed therein so long as the switch 432 is accessible and a battery pack may be inserted into and removed from the housing. This permits the battery pack to be easily replaced once it becomes drained.

The present invention provides an improved alpine ski boot 10 which overcomes all of the disadvantages associated with conventional ski boots 10. By incorporating the articulating truss assembly 130 along with the hinge 70 into the ski boot 10 design, the ski boot 10 offers both a rigid ski boot for performance and to properly activate safety bindings (in the ski mode); and at the same time, a bendable ski boot is also provided in the walk mode. Pressing the hard shell of the ski boot 10 against the inner bladder 260 is eliminated at the forefront and ankle by inclusion of the first and second straps 270, 280 which offer positive hold down of the forefoot and the heel. This improves comfort. Performance is also enhanced by providing instant feedback of steering motions to the hard shell of the ski boot 10 and hence to the skis 200. All of the aforementioned features work together to provide both a walkable and skiable boot 10 that fits standard safety bindings.

As one of skill in the art appreciates, heel lift is a real deterrent to skiing performance and has never been effectively dealt with in hard boot construction as there is no effective way to affix an ankle to heel strap on a hard boot. The internal ankle heel strap system (strap 280) remedies this and improves ski performance over regular hard boots.

While the invention has been particularly shown and described with reference to preferred embodiments thereof, it will be understood by those skilled in the art that various changes in form and details may be made therein without departing from the spirit and scope of the invention.

What is claimed is:

1. A ski boot for releasable attachment to a binding mounted on an alpine ski, the boot comprising:

a sole having a toe end and a heel end, the toe end having a portion to be releasably captured in the binding and the heel end having a portion to be releasably captured in the binding;

a substantially rigid boot upper adapted to receive a foot, the boot upper including:

a toe upper portion;

a heel upper portion; and an inner bladder disposed within the toe and heel upper portions; and an inner bladder assembly to hold the foot on the ski boot sole, the assembly including:

a first adjustable internal member disposed within the boot upper across a front portion of the inner bladder;

a second adjustable internal member disposed within the boot upper across a rear portion of the inner bladder;

a first device operatively connected to the first adjustable internal member for tightening and loosening the first adjustable internal member;

a second device operatively connected to the second adjustable internal member for tightening and loosening the second adjustable internal member;

wherein the first and second devices are disposed on exterior surfaces of the boot upper; and an articulated truss member having a first end and an opposing second end, the first end being pivotally connected to the toe upper portion such that the second end pivots between the first open position in which the second end is free of engagement with the heel upper portion and a second locked position in which the second end engages the toe heel portion and prevents pivotal movement of the toe upper portion and the first sole portion relative to the heel upper portion and the second sole portion.

2. The ski boot of claim 1, wherein the first end of truss member has a spring loaded hinge which permits the second end of the truss member to pivot open once the second end is released from engagement with the heel upper portion.

3. The ski boot of claim 1, wherein the truss member has retaining features formed on a lower surface thereof which mate with complementary retaining features formed in a truss section of the heel upper portion, the heel upper portion receiving the second end of the truss member when the truss member is lockingly engaged to the truss section in the second position.

4. The ski boot of claim 1, wherein the truss member has an adjustable locking mechanism including a knob operatively connected to one or more locking members which engage the heel upper portion in the second locked position for locking the truss member to the heel upper portion.

5. The ski boot of claim 4, wherein the locking mechanism further includes:

a cam member coupled to the knob; and the one or more locking members comprises a pair of biased locking flanges at least partially disposed in flange compartments formed in the truss member, the flange compartments being open along lateral faces of the truss member.

6. A ski boot for releasable attachment to a binding mounted on an alpine ski, the boot comprising:

a sole having a toe end and a heel end, the toe end having a portion to be releasably captured in the binding and the heel end having a portion to be releasably captured in the binding;

a substantially rigid boot upper adapted to receive a foot, the boot upper including:

a toe upper portion;

a heel upper portion; and an inner bladder disposed within the toe and heel upper portions; and an inner bladder assembly to hold the foot on the ski boot sole, the assembly including:

a first adjustable internal member disposed within the boot upper across a front portion of the inner bladder;

a second adjustable internal member disposed within the boot upper across a rear portion of the inner bladder;

a first device operatively connected to the first adjustable internal member for tightening and loosening the first adjustable internal member;

a second device operatively connected to the second adjustable internal member for tightening and loosening the second adjustable internal member;

wherein the first and second devices are disposed on exterior surfaces of the boot upper; and wherein the first adjustable internal member is attached to the first device by a pair of spaced first cables which are fitted through openings formed in the toe upper portion, the second adjustable internal member being attached to the second device by a pair of spaced second cables which are fitted through openings formed in the heel upper portion, and wherein each of the first and second devices includes a rotatable member to which at least one cable is attached and a ratchet mechanism operatively connected to the rotatable members for selectively winding or unwinding the at least one cable, thereby causing one of the first and second adjustable internal members to tighten or loosen.

7. The ski boot of claim 6, wherein the sole includes:

a substantially rigid first sole portion extending rearwardly from the toe end to a rear pivot end of the first sole portion;

a substantially rigid second sole portion with a front pivot end adjacent to the rear pivot end of the first sole portion, the second sole portion extending from the front pivot end toward the heel end of the sole; and a hinge connecting the rear pivot end of the first sole portion to the front pivot end of the second sole portion such that the first sole portion is at least upwardly pivotable from a position in planar alignment with the second sole portion when the sole is free from the binding and the ski boot is in a first open position.

8. The ski boot of claim 6, wherein the toe upper portion and the heel upper portion define between them a clearance in the boot upper permitting pivotal movement of the first sole portion relative to the second sole portion.

9. The ski boot of claim 6, wherein the ratchet mechanism includes a ratchet wheel operatively connected to the rotatable member and an adjustable pawl which engages teeth of the ratchet wheel to hold the ratchet wheel in a given position.

10. The ski boot of claim 9, wherein the pawl has a tip which is biased against the teeth of the ratchet wheel so as to prevent movement of the ratchet wheel.

11. A ski boot for releasable attachment to a binding mounted on an alpine ski, the boot comprising:

a sole having a toe end and a heel end, the toe end having a portion to be releasably captured in the binding and the heel end having a portion to be releasably captured in the binding, the sole including:

a substantially rigid first sole portion extending rearwardly from the toe end to a rear pivot end of the first sole portion;

a substantially rigid second sole portion with a front pivot end adjacent to the rear pivot end of the first sole portion, the second sole portion extending from the front pivot end toward the heel end of the sole; and a hinge connecting the rear pivot end of the first sole portion to the front pivot end of the second sole portion such that the first sole portion is at least upwardly pivotable from a position in planar alignment with the second sole portion when the sole is free from the binding and the ski boot is in a first walking mode;

a substantially rigid boot upper adapted to receive a foot, the boot upper including:

a toe upper portion supported on the first sole portion; and a heel upper portion supported on the second sole portion;

wherein the toe upper portion and the heel upper portion define between them a clearance in the boot upper permitting pivotal movement of the first sole portion relative to the second sole portion in the first walking mode;

an articulated truss member pivotally connected to the toe upper portion and pivoting between the first walking mode and a second skiing mode in which the truss member lockingly engages the heel upper portion and prevents pivotal movement of the toe upper portion and the first sole portion relative to the heel upper portion and the second sole portion, thereby locking the first and second sole portions in planar alignment relative to each other;

an inner bladder disposed within the toe and heel upper portions; and an inner bladder assembly to adjustably hold the foot on the ski boot sole, the assembly including:

a first adjustable internal member disposed within the boot upper across a front portion of the inner bladder for preventing foot lift in said ski boot, thereby increasing ski control;

a second adjustable internal member disposed within the boot upper across a rear portion of the inner bladder for preventing heel lift in said ski boot, thereby increasing ski control;

a first device operatively connected to the first adjustable internal member for tightening and loosening the first adjustable internal member;

a second device operatively connected to the second adjustable internal member for tightening and loosening the second adjustable internal member; and wherein the first and second devices are disposed on exterior surfaces of the boot upper.

12. The ski boot of claim 11, wherein the heel upper portion has a slot formed in a forward portion thereof, said truss member covering said slot in said second skiing mode, said slot permitting said heel upper portion to be resiliently separated to accommodate foot entry into said ski boot.

13. A ski boot for releasable attachment to a binding mounted on a ski, the boot comprising:

a sole having a toe end and a heel end, the toe end having a portion to be releasably captured in the binding and the heel end having a portion to be releasably captured in the binding;

a substantially rigid boot upper adapted to receive a foot, the boot upper including:

a toe upper portion;

a heel upper portion; and an inner bladder disposed within the toe and heel upper portions; and an inner bladder assembly to hold the foot on the ski boot sole, the assembly including:

a first adjustable internal member disposed within the boot upper across a front portion of the inner bladder;

a first device operatively connected to the first adjustable internal member for tightening and loosening the first adjustable internal member;

wherein the first device is disposed on exterior surfaces of the boot upper; and wherein the first adjustable internal member is attached to the first device by a pair of cables which are fitted through openings formed in the toe upper portion, the first device includes a rotatable member to which at least one cable is attached and a ratchet mechanism operatively connected to the rotatable member for selectively winding or unwinding the at least one cable, thereby causing the first adjustable internal member to tighten or loosen.

14. The ski boot of claim 13, further comprising:

a second adjustable internal member disposed within the boot upper across a rear portion of the inner bladder;

a second device operatively connected to the second adjustable internal member for tightening and loosening the second adjustable internal member;

wherein the second device is disposed on exterior surfaces of the boot upper; and wherein the second adjustable internal member is attached to the first device by a pair of cables which are fitted through openings formed in the heel upper portion, the second device includes a rotatable member to which at least one cable is attached and a ratchet mechanism operatively connected to the rotatable member for selectively winding or unwinding the at least one cable, thereby causing the second adjustable internal member to tighten or loosen.

15. The ski boot of claim 13, wherein the first adjustable internal member is fixed relative to the ski boot sole at a first side of the ski boot opposite to where the first device is disposed and wherein the second adjustable internal member is fixed relative to the ski boot sole at the first side of the ski boot opposite to where the second device is disposed.

16. The ski boot of claim 14, wherein the ratchet mechanism for each of the first and second devices includes a ratchet wheel operatively connected to the respective rotatable member and an adjustable pawl which engages teeth of the ratchet wheel to hold the ratchet wheel in a given position.

* * * * *